US006890288B2

(12) United States Patent
Bingham

(10) Patent No.: US 6,890,288 B2
(45) **Date of Patent: *May 10, 2005**

(54) METHOD AND APPARATUS TO EXERCISE DEVELOPMENTALLY DELAYED, PHYSICALLY AND/OR NEUROLOGICALLY IMPAIRED PERSONS

(75) Inventor: Anne Bingham, East Northport, NY (US)

(73) Assignee: Community Products LLC, Rifton, NY (US)

( * ) Notice: Subject to any disclaimer, the term of this patent is extended or adjusted under 35 U.S.C. 154(b) by 215 days.

This patent is subject to a terminal disclaimer.

(21) Appl. No.: 09/847,683

(22) Filed: May 2, 2001

(65) Prior Publication Data

US 2001/0027149 A1 Oct. 4, 2001

Related U.S. Application Data

(60) Continuation-in-part of application No. 09/676,674, filed on Oct. 2, 2000, which is a continuation-in-part of application No. 09/412,189, filed on Oct. 6, 1999, now Pat. No. 6,080,087, application No. 09/847,683, which is a continuation-in-part of application No. 09/602,700, filed on Jun. 24, 2000, now Pat. No. 6,244,991, which is a division of application No. 09/412,189, filed on Oct. 5, 1999.

(60) Provisional application No. 60/196,261, filed on Apr. 11, 2000.

(51) Int. Cl.[7] ..... A63B 26/00; A61H 3/00

(52) U.S. Cl. ..... 482/69; 602/36

(58) Field of Search ..... 482/69, 23, 43, 482/54, 904; 602/36

(56) References Cited

U.S. PATENT DOCUMENTS 1,642,184 A 9/1927 Urso
2,675,856 A 4/1954 Abdallah ..... 482/69
3,582,069 A 6/1971 Flick ..... 272/79

(Continued)

OTHER PUBLICATIONS

Webpage entitled: "Redbarn Enterprises" http://www.red–enter.com/prodpages/creepster.htm, Dec. 19, 2001. 2001.

(Continued)

*Primary Examiner*—Stephen R. Crow
(74) *Attorney, Agent, or Firm*—Cooper & Dunham LLP

(57) ABSTRACT

An exercise assistive device to help a developmentally developed person, or a physically or neurologically impaired person, such as a child or adult, develop vestibular balance and muscle control, so that the person can learn to perform mobility activities, such as crawling, sitting upright, standing or walking. The device includes a support frame supporting a body suit that is moved longitudinally, and optionally transversely and rotationally. The body suit may be optionally spinally supported. The body suit is optionally suspended from either a hand-held frame, like a marionette, or from a floor-mounted, wall-mounted or ceiling mounted frame with a glidable support dolly. Flexible connector straps are provided between the body suit and body suit glidable support dolly and made of a material such as reinforced fabric, elastic or canvas. These connector straps are positioned in spaced-apart relation to one another about the body suit. The body suit is suspended from the seat-support leg by the connector straps that extend between the body suit and fasteners. The fasteners upon the body suit are strategically placed to assist the person assume various postural positions ranging from the upright sitting or standing position, such as at the shoulders, to oblique or horizontal crawling quadruped positions. The person may be encouraged to travel forward, backward or sideways by sensory attractive items, such as mirrors, toys, netting arrays or pull bars.

5 Claims, 19 Drawing Sheets

U.S. PATENT DOCUMENTS

| | | | | |
|---|---|---|---|---|
| 3,721,436 | A | 3/1973 | Barthel | 272/70 |
| 3,780,663 | A | 12/1973 | Pettit | 104/1 |
| 3,992,023 | A | 11/1976 | Moorer | |
| 4,050,737 | A | 9/1977 | Jordan | 297/465 |
| 4,252,063 | A | 2/1981 | Brooks, Jr. | 104/89 |
| 4,445,502 | A | 5/1984 | Swan et al. | 128/25 |
| 4,569,532 | A | 2/1986 | Mirkarimi | 280/87 |
| 4,796,903 | A | 1/1989 | Proctor | 280/87 |
| 4,875,689 | A | 10/1989 | Lin | 473/573 |
| 4,981,110 | A | 1/1991 | Llewellyn | 119/96 |
| 4,981,307 | A | 1/1991 | Walsh | 280/290 |
| 5,156,176 | A | 10/1992 | Doorenbos | 135/67 |
| 5,356,355 | A | 10/1994 | Campbell | 482/43 |
| 5,407,406 | A | 4/1995 | Canela | 482/51 |
| 5,458,550 | A | 10/1995 | Braim | 482/69 |
| 5,498,219 | A | 3/1996 | Soufi | 482/69 |
| 5,502,851 | A | 4/1996 | Costello | 5/86.1 |
| 5,569,129 | A | 10/1996 | Seif-Naraghi | 482/69 |
| 5,603,676 | A | 2/1997 | Cymbalisty | 482/56 |
| 5,626,540 | A | 5/1997 | Hall | 482/69 |
| 5,667,461 | A | 9/1997 | Hall | 482/69 |
| 5,702,326 | A | 12/1997 | Renteria | 482/68 |
| 5,766,114 | A | 6/1998 | Campbell | 482/55 |
| 5,819,322 | A | 10/1998 | Dicker et al. | 2/456 |
| 5,872,438 | A | 2/1999 | Roston | 318/568 |
| 5,902,016 | A | 5/1999 | Moran et al. | 297/484 |
| 6,080,087 | A | 6/2000 | Bingham | 482/69 |
| 6,244,991 | B1 | 6/2001 | Bingham | 482/69 |

OTHER PUBLICATIONS

Webpage entitled: "Adaptivemall.com Tumble Forms online" http://www.tumbleforms.com/senin.html, Dec. 19, Webpage entitled: "Southpaw Enterprises" http://www.southpawenterprises.com/html/products/product.asp?item=2290, Feb. 11, 2002.

Advertisement entitled: "Safe Support, Puts Security In Your Hands".

Advertisement entitled: "Make Those First Steps Easier (For Both Of You)".

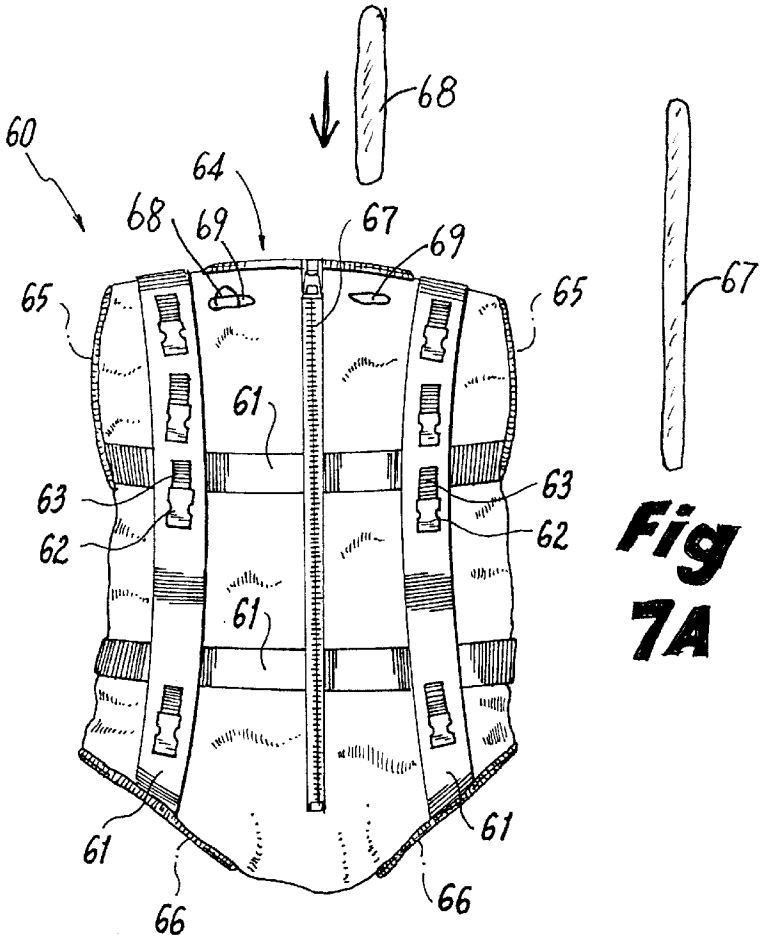
Fig 7A
Fig. 7B
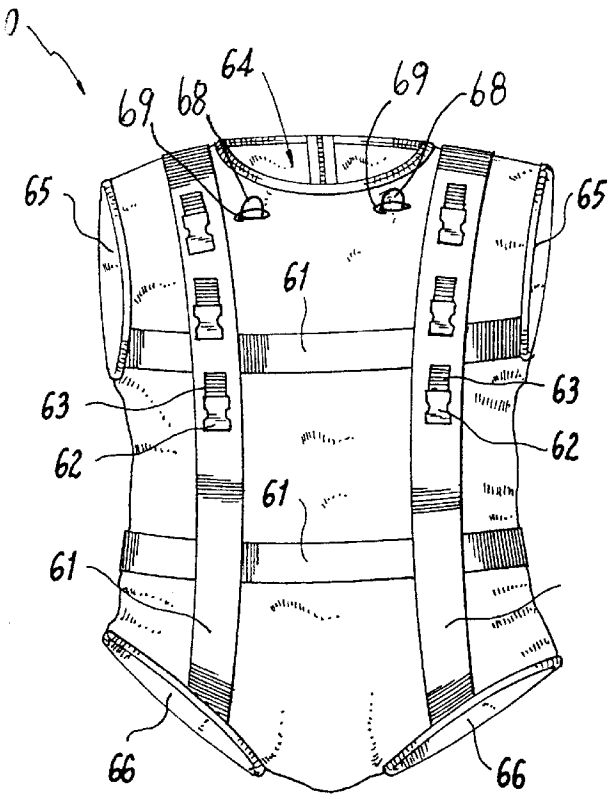
Fig. 6A

MODE OF USE FOR DEVELOPMENTALLY DELAYED CHILD 408
407
426
486
416
407
401
486
426
409
410
412
412
471
471
412
460
412

METHOD AND APPARATUS TO EXERCISE DEVELOPMENTALLY DELAYED, PHYSICALLY AND/OR NEUROLOGICALLY IMPAIRED PERSONS

This application is a continuation-in-part of application Ser. No. 09/676,674, filed Oct. 2, 2000, which application is a continuation-in-part of provisional application Ser. No. 60/196,261 filed Apr. 11, 2000, which application is a continuation-in-part of application Ser. No. 09/412,189 filed Oct. 6, 1999 now U.S. Pat. No. 6,080,087. This application is also a continuation-in-part of application Ser. No. 09/602,700 filed Jun. 24, 2000, now U.S. Pat. No. 6,244,911 which application is a division of application Ser. No. 09/412,189 filed Oct. 5, 1999.

The subject matter of the aforementioned patent applications is incorporated by reference herein.

FIELD OF THE INVENTION

The present invention relates to methods and devices to promote ambulation in developmentally disabled persons, especially children, as well as physically and neurologically impaired persons.

BACKGROUND OF THE INVENTION

The invention relates to a method and apparatus used to help developmentally delayed, physically and/or neurologically impaired persons, such as children or adults, exercise specific muscle groups, practice movement strategies and gain strength necessary to sit, to crawl, and to walk.

The prior art is replete with assistive devices. A sampling of the patents in this field is as follows. U.S. Pat. No. of 1,642,184 of Urso and U.S. Pat. No. 3,721,436 of Barthel, Jr. describe exercise and walker devices that support an individual in a harness and permits movements over a two-dimensional area and up and down adjustments. However in Urso and Barthel, Jr. '436, the harnesses only hold the person in an upright position, which does not assist the person in quadruped, crawling positions, which are necessary to strengthen arm development and to facilitate vestibular development for better balance, thus preventing the child to easily tip over and injure itself.

U.S. Pat. No. 3,582,069 of Flick and Burke discloses a crawling assistive device that is a sled type with movable hand and knee pads operated by linkages. It does not describe a body suit or body suit, which can assist a developmentally disabled person, or a physically or neurologically impaired person, such as a child or adult, from learning to master the quadruped, crawling position as well as transition therefrom to a myriad of other positions while facilitating vestibular development through wide range movement opportunities such as bouncing, rocking and spinning.

U.S. Pat. No. 3,992,023 of Moorer describes a crawling assistive device that is a sled on wheels. It also does not describe a body suit or harness which can assist a developmentally disabled person, or a physically or neurologically impaired person, such as a child or adult, from learning to master the quadruped, crawling position as well as transition therefrom to a myriad of other positions while facilitating vestibular development.

U.S. Pat. No. 4,569,532 of Mirkarimi illustrates a crawling assistive device similar to Moorer, but one where the child leans forward obliquely. It also does not describe a body suit or harness which can assist a developmentally disabled person, or physically or neurologically person, such as a child or adult, from learning to master the quadruped, crawling position while promoting vestibular development through various movement opportunities.

U.S. Pat. No. 4,796,903 of Proctor and U.S. Pat. No. 5,407,406 of Canela both describe sling type crawling assistive devices of a sling type with harnesses attached to the sling. These devices limit the developmentally disabled child to just the creeping position, thereby restricting transition into alternative postures. In addition, the child's body is in close proximity to a rigid, supportive frame.

U.S. Pat. No. 4,252,063 of Brooks and U.S. Pat. No. 3,780,663 of Pettit both relate to orthopedic supporters to hold a person in a standing position as a harness is moved along a track, similar to the orientation in Barthels, Jr. '436.

Campbell's U.S. Pat. No. 5,766,114 describes an infant walking and swimming aid that includes a harness with shoulder straps to hold the child from above and a chest strap to keep the child upright. However, Campbell '114 does not promote quadruped, weight bearing activities.

Among commercially available devices include the Deltoid Aid arm counterbalance system, which includes slings to hold a forearm in. The slings are supported from above by a frame. A similar sling device lifts a person hydraulically. The Deluxe Vestibulator II by Tumbleforms holds a child horizontally in a sling, but the child's feet lay in the sling and the touching of the hands upon the floor is in a limited, weight-bearing fashion. These devices also prevent the child from developing sufficient strength and orientation needed for creeping and crawling. In addition, the child can fall out of the sling. These devices limit the developmentally disabled child to just the creeping position, thereby restricting transition into alternative postures. In addition, the child's body is in close proximity to a rigid, supportive frame.

In contrast to the prior art devices, the present invention uses a body suit to carefully distribute the stresses placed upon the body by the supporting straps. In addition, multiple attachment points permit the straps to adjustably counteract gravity in such a manner as to assist a person, such as a child or an adult, in attaining sitting, standing and crawling postures. Along with a supporting frame and track, as provided in several of the prior art devices, exercise and conditioning is tailored to the developmentally delayed, physically impaired, and/or neurologically impaired person, such as a child or adult.

OBJECTS OF THE INVENTION

It is therefore an object of the present invention to help developmentally delayed, physically and/or neurologically impaired children or adults exercise specific muscle groups, practice movement strategies and gain strength necessary to sit, to crawl, and to walk.

It is also an object of the present invention to provide visually and/or tactilely attractive targets, such as pull bars, mirrors, nets or toys, to enhance the movement strategies of the developmentally delayed and/or physically or neurologically impaired person being helped.

It is also an object of the present invention to help the developmentally delayed, physically and/or neurologically impaired person, such as a child or adult, to master the sitting position.

It is also an object of the present invention to provide an exercise device, which promotes a "righting" response that will cause a developmentally disabled or physically or neurologically impaired person, such as a child or adult, to assume an upright position.

It is also an object of the present invention to develop a protective arm response in a developmentally disabled or physically or neurologically impaired person, such as a child or adult, in order to prevent the person from falling, and to maintain upright balance.

It is also an object of the present invention to provides a device, which promotes dynamic, wide range neck and trunk control exercise opportunities, which are essential and foundational to all other physical development.

It is also an object of the present invention to assist the person in quadruped, crawling positions.

It is also an object of the present invention to strengthen arm development and to facilitate vestibular development for better balance.

It is also an object of the present invention to assist a developmentally disabled person, or a physically or neurologically impaired person, such as a child or adult, from learning to master the quadruped, crawling position while facilitating vestibular development.

It is also an object of the present invention to provide a frame-supported or manually supported body suit, which can safely assist a developmentally disabled person, or a physically or neurologically impaired person, such as a child or adult, from learning to master the quadruped, crawling position.

It is yet also an object of the present invention to provide a hand-held supported body suit, which can also safely assist a developmentally disabled person, or a physically or neurologically impaired person, such as a child or adult, for learning to master the quadruped, crawling position.

It is also an object of the present invention to provide such a body suit with optional spinal supports to assist the person in staying erect or in a quadruped position, once having achieved an erect or quadruped position.

It is also an object of the present invention to promote quadruped, weight bearing activities in a developmentally disabled person, or a physically or neurologically impaired person, such as a child or adult.

It is also an object of the present invention to lift gravity off of the developmentally delayed person, or physically and/or neurologically impaired person, such as a child or adult, thereby making it possible for the person, such as a child or adult, to assume weight bearing positions that they would otherwise probably not be able to assume.

It is another object of the present invention to promote an upright standing posture and weight bearing through the legs in preparation to walk.

It is yet another object of the present invention to allow a therapist to modulate their therapeutic handling of a person, such as a child or adult, and to change positions with simple adjustments.

It is yet another object of the present invention to provide a device, which permits the disabled person, such as a child or adult, to make movement choices and to positively interact with the environment.

It is yet another object of the present invention to enable a developmentally delayed person, or a physically and/or neurologically impaired person, such as a child or adult, to learn where they are in space in relation to other objects, to help them learn depth perception.

It is yet another object of the present invention to enable a developmentally disabled person, such as a child or adult, to ambulate safely.

It is yet another object of the present invention to provide a device that allows a developmentally delayed person, or a physically and/or neurologically impaired person, such as a child or adult, to exercise and to facilitate transition into several postural and ambulatory positions.

It is yet another object of the present invention to improve over the disadvantages of the prior art.

SUMMARY OF THE INVENTION

In keeping with the aforementioned objects and others which may become apparent, the present invention relates to an exercise assistive device to help a developmentally developed person, or a physically and/or neurologically impaired person, such as a child or an adult, develop vestibular balance and muscle control, so that the person can learn to perform mobility activities, such as crawling, sitting upright, standing or walking.

Structurally, in a preferred embodiment, the device includes a support such as a hand-held hanger, a wall mounted frame, a ceiling mounted frame or a frame having a upstanding base legs with a connecting frame extending therebetween. In the frame embodiments, a body suit glidable support dolly is mounted upon the frame, and travels preferably longitudinally, transversely and rotationally thereupon. In alternate embodiments, the body suit may travel longitudinally, without transverse movements or without rotation. Moreover, the rotation can be temporarily disabled with a locking pin.

The body suit is suspended from the suit glidable support dolly, or from a hand-held hanger.

Flexible connector straps are provided between the body suit and body suit support, such as the glidable support dolly or hand-held hanger and are made of a material such as reinforced fabric, elastic or canvas. These connector straps are positioned in spaced-apart relation to one another about the body suit glidable support dolly.

The body suit is suspended from the frame or hanger by the connector straps that extend between the body suit and fasteners attached to the glidable support dolly. Each connecting strap is connected to a respective fastener upon the body suit support at one end and to a further fastener upon the body suit.

Unlike prior art harnesses which only hold a person in an upright sitting or standing position, in the present invention those fasteners upon the body suit are strategically located to assist the person, such as a child or adult, assume various postural and/or ambulatory positions ranging from the upright sitting or standing position, wherein the straps are connected at the shoulders, to oblique or horizontal crawling quadruped positions, wherein the straps are also connected at the rear hip area.

The preferable configuration of strap attachments is similar to those connected to the torso area of a marionette. This configuration facilitates the vertically upright, oblique or horizontal positions.

Preferably there is provided optional visually and/or tactilely sensory attractive targets, such as pull bars, mirrors, nets or toys, to enhance the movement strategies of the developmentally delayed and/or physically or neurologically impaired person being helped.

These sensory attractive targets give an incentive to the person to advance further ahead. The pull bars optionally extend from the support frame, enabling the person to grasp the pull bar to advance forward, backward or sideways, and to increase muscle strength by pulling towards or away from the pull bar.

For persons with ascertainable vision, the sensory attractive targets are visually attractive, such as mirrors or toys.

For visually impaired persons, the sensory attractive targets may be tactilely attractive items, such as soft toys or arrays of netting having a texture and tactile arrangement that can be grasped at the completion of a journey ahead. Therefore, the visually impaired person can learn that the tactilely attractive item, such as the netting or toy, is several crawling steps ahead from a predetermined starting point of travel, without visually seeing the target.

Furthermore, a height adjustment member is provided to hold the person, such as a child or adult, at a predetermined height, which can be adjusted up or down, to enable the person, such as a child or adult, to move down to a hand and knee weight bearing crawling position, or up therefrom in a non-weight bearing, suspended position from above.

Although the device can be used for any person, including disabled adults, the above noted assistive exercise body suit and track system is primarily designed for developmentally disabled children. However, it can also be used with other types of physically impaired or neurologically impaired persons.

In operation, a developmentally disabled person, or a physically or neurologically impaired person, such as a child or adult, is placed in the body suit outfit and the set of fasteners are connected to the body suit to maintain the person, such as a child or adult, in the aforementioned upright sitting position, primarily located in the shoulder areas. The further sets of fasteners are attached to the rear hip area to help to facilitate the person, such as a child or adult, in a quadruped, crawling position.

An optional set of fasteners is also provided in the side front abdominal area to maintain the person, such as a child or adult, in a standing position, in conjunction with the rear shoulder fasteners. Other fasteners can also be provided in the front chest area.

The fasteners are connectable to the flexible but inelastic fabric connector cords or straps, such as polypropylene straps, similar to that used in backpack straps. If more bounce is desired, such as in the hand-held versions, then an elastic material may be used in the straps. These connector straps are connected to the body suit support, such as, for example, to a hand-held support hanger which may be a frame or disk, or to a glidable support dolly, which is slidably movable back and forth in axial directions along a pair of primary tracks of the support track system. In the frame supported embodiment, the support dolly preferably includes wheels or rollers engagable with the respective primary tracks.

In an alternate embodiment, the support dolly comprises a further set of secondary tracks placed perpendicular to the axis of the primary tracks. In this embodiment, the dolly therefore includes a further dolly support which is movable along the secondary tracks, in opposite directions which are transverse to the axial direction of the primary tracks.

Such configuration is similar to a gantry, which moves in three axes, namely front, back and sideways.

Furthermore, the primary dolly support tracks are supported by upright stanchions, or by arches. However, the dolly support tracks may be also supported by horizontally oriented wall-mounted brackets, or by vertically descending ceiling-mounted brackets.

In yet a further embodiment, an optional lockable rotating wheel attached to the glidable support dolly allows for rotational directional change while the dolly moves along the tracks.

Therefore, the present invention is a method and apparatus used to help developmentally delayed persons, or physically and/or neurologically impaired persons, such as children or adults, exercise muscle groups necessary to sit, crawl (creep) and walk.

This multi-functional therapeutic device comprises a body suit with an overhead suspension system. The body suit is custom fit to each child or adult. It includes fasteners on suit, which allow for position change. The overhead system includes either hand-held supports or a dolly that runs along a primary track.

The body suit may have optional spinal supports to assist the person in staying erect or in a quadruped position, once the person has achieved an erect or quadruped position.

When the person, such as a child or adult, begins to move, the overhead system responds allowing the person, such as a child or adult, to "feel" a slight falling sensation which will create an opportunity for a postural response to stay upright that will cause the person, such as the child or adult, to come upright. The person, such as the child or adult, is safe from hitting the ground because of straps, which suspend the person, such as the child or adult, from the suit to an overhead assembly. This overhead assembly may optionally include a rotational member, such as a hanger or disk, which allows for rotational directional change along the track. The system may also include a buoyancy feature provided by an optional compression spring within the overhead system, or by the use of elastic connector straps. This means that the person, such as the child or adult, will experience a bouncing sensation, which helps to elicit further attempts to move and exercise.

In developmentally advanced children, weight bearing is essential in typical development. Such a child first learns to hold his or her head upright while developing a "protective arm response" in order to prevent a fall and maintain balance.

After this crucial milestone is achieved, a typical developmentally advanced child then learns to come up on its forearms and eventually on extended arms. This weight bearing through the arms prepares them for creeping. Eventually, a typical developmentally advanced child likewise bears weight through the legs in preparation for walking. In contrast, the developmentally delayed child, however, due to an underlying neuro-muscular impairment is often too weak to begin this process, or might achieve some of it yet at a much slower pace.

The severely disabled child may never achieve these milestones at all.

Therefore, the present invention is designed to lift gravity off of the developmentally delayed person, or off of the physically and/or neurologically impaired person, making it possible for them to assume weight bearing positions that they would otherwise probably not be able to assume.

With respect to upright sitting positions, most children learn to sit up by six to eight months old. Prior to achieving this milestone, they have had hundreds and thousands of opportunities to practice this basic skill, including slight rocking front to back and side to side while in their mother's arms or up against a crib side, for example.

Unlike typical developmentally advanced children, the developmentally delayed, child is too weak to attempt this basic rocking practice. The first place to start treating a developmentally delayed child is then in the sitting position. The child is placed in the body suit and fasteners on the body suit at about the front and back shoulder area are attached to the connector straps that suspend the weight of the person, to an overhead rail. The same procedure applies for physically and/or neurologically impaired persons, including children and adults.

As the person, such as the child or adult, moves, the dolly responds accordingly, allowing the person, such as a child or adult, to experience a "falling sensation". In order to come upright, the person, such as a child or adult, must use muscles in the neck and trunk area, as well as the abdominal area.

These attempts to right themselves provides these persons with the much-needed opportunity for exercise. To date, there is no other prior art device which provides such dynamic, wide range exploration to the postural system. Yet, neck and trunk control exercise opportunities are essential and foundational to all other physical development.

To begin treating a developmentally disabled child or the physically impaired or neurologically impaired person, in the present invention, one would first need to evaluate the person's physical condition. If the child has not yet achieved head and trunk control, or if due to physical or neurological impairment the person has lost head and neck control, this would probably be the best place to start. The child or adult is placed in sitting and the therapist or attendant determines the tension on the glider, which rolls above in response to the child's or adult's attempts to sit. The therapist also determines the length of travel along the rail.

For example, a severely disabled child only needs a short distance, of perhaps six inches in all directions to begin learning to sit upright.

If after some degree of head and trunk control is achieved, or if therapists determine it to be beneficial, the child or adult is then placed on all fours in a quadruped position in preparation to creep. The fasteners are placed on the upper and lower back portions of the suit. Again, the therapist or attendant determines the level of difficulty in tension and length of travel.

Likewise, standing is then attempted by placing the child or adult in front and back upper fasteners and by height adjustment on the rotational overhead assembly, so that the child's or adult's feet touch the floor in order to weight bear.

Optionally, visual stimuli can be added to the present invention to encourage the person, such as a child or adult, to move forward. For example, if the upstanding frame embodiment is used, a kit can be provided with a safety mirror with soft edges can be placed beyond one set of legs, to attract the person, such as the child or adult, to advance forward. On the other hand, at the other end of the frame, the kit can also include a net which can be strung between two legs to hold toys which might attract the child's or adult's attention.

This system of the present invention allows a therapist to modulate their therapeutic handling of a person, such as a child or adult, and to change positions with simple adjustments. Unlike other equipment used to exercise developmentally delayed, physically and/or neurologically impaired persons, the present invention does not limit a person, such as a child or adult, to a single postural or ambulatory position. It allows the person, such as a child or adult, to practice movement strategies, make movement choices and interact with the environment.

Many developmentally delayed, physically and/or neurologically impaired persons need to learn where they are in space in relation to other objects, such as the floor or mirror for example, which could be placed near the person, such as a child or adult, to help them learn depth perception.

Many developmentally delayed persons, or physically and/or neurologically impaired persons, also suffer from sensory perception problems. For example, many have visual problems which make ambulating about the house in a conventional walker dangerous. They can fall down a step or bump into furniture, often hurting themselves. Unlike most other devices used by developmentally delayed, physically and/or neurologically impaired persons, the device of the present invention provides an opportunity for the impaired person, such as a child or adult, to learn how to control his/her own body without being strapped in or down to a hard, rigid cage or walker, which must then be carried about with them.

Feeling their own bodies move and touching the floor gives these persons "proprioceptive input", which is desperately craved by many developmentally delayed persons, or by physically and/or neurologically impaired persons. They enjoy the sensation of bouncing and spinning, because it provides vestibular input into the brain, which causes them to become more alert and able to respond more appropriately to their environment.

Furthermore, there are many adaptive devices that provide a developmentally delayed person, or a physically and/or neurologically impaired person, with the opportunity to assume proper body alignment. Standing boards, walker type devices and even seating equipment can provide a challenged person with a rigid surface that their bodies can be strapped to for support. Many of these devices come with optional supports for the trunk area as well as the neck and head. However, the individual using this type of equipment is "all strapped up" and does not have much of an opportunity to explore various movement sensations and learn necessary reactive skills that would not only build muscle strength but would also help the person to learn necessary balance skills needed to prevent a fall.

This therapeutic exercise device which uses a body suit, suspension straps and an overhead supportive track/glider system, provides the challenged person with an opportunity to not only assume various body positions, but also provides the freedom of movement necessary to build muscle strength while learning balance skills.

However, for those individuals who have not yet achieved head and trunk control, it may be necessary to provide additional support through the use of a detachable neck collar which can be attached to the body suit. With this additional support, the severely impaired person is then more likely to have greater control over head and trunk movements yet without being strapped against a rigid surface. The collar can be made of foam or a similar material that would provide flexible support. The lower rim of the collar may also include a more rigid support such as a rubber or plastic reinforcement band which can add some rigidity to the collar yet still allow for flexibility. To completely restrict movement and provide full support to the neck and head is not always desirable as the main object of this device is to provide an opportunity for range of motion and an opportunity for the individual to learn and develop skills necessary for independent movement or at least increased mobility. Yet, in some cases, if an individual requires some additional support of the neck and trunk area, this detachable collar would provide that support if needed and can then be removed once strengthening as been achieved. The collar attaches to the suit at around the neck area by snap on fasteners or perhaps a hook and loop attachment. In either case, the collar would also come with a removable "casing" that can be laundered. Similar to a pillow case and pillow, the outer "case" of the collar can be removed and washed. This way, the foam inner support would not undergo the wear and tear of laundering. The attachment of the support collar to the suit can be of a snap on nature such as is used to close a jean jacket or perhaps may also include but not be limited to a hook and loop closure. The shape of the collar can be horseshoe shaped. It would come up higher in the back to prevent the person from "hyper extending" the neck backward but would then taper down around the sides and to the front leaving an opening by the neck area to accommodate breathing or tracheostomy tubes.

Furthermore, in another alternate embodiment, the body suit to this system can be made adjustably available in different styles to accommodate usage in the home as well as in centers or school. Those for the home can be lighter in weight and form fitted to each person. Those used in centers can be made to adjust in size to accommodate persons within particular size ranges. It can be made of a heavier material such as a quilting or padding with a nylon exterior to provide strength to the garment.

The adjustable suit can be made up of "quadrants" both in the front and the rear which can be drawn together or distanced in order to adjust the suit to fit the user. The quadrants would be connected by a more flexible material such as a LYCRA or SPANDEX material that would allow for both expansion when length increase is desired yet would also form a gathering when brought together to decrease distance between quadrants.

Size adjustments can be made by using an incremental adjustable fastener (similar to a fastener on a ski boot) which would connect two quadrants. Once proper size is selected the fastener can be secured by flipping the fastener cover backward and into a locked position.

To adjust the height size, the lower half and upper half of the suit can be brought together or distanced by selecting a position on the fastener and pulling the "tongue" tab through the fastener closure "tunnel" or by depressing the lever to distance the two halves of the suit. The fasteners can be placed at about the side seam area. To adjust the suit width, the same procedure would be used but by bringing the two rear sides together or apart and then selecting a position along the fasteners and engaging the locking mechanism by pulling the tab back and locking the fastener at a determined point.

BRIEF DESCRIPTION OF THE DRAWINGS

The present invention can best be understood in conjunction with the accompanying drawings, in which:

FIG. 6A is a front view of an alternate embodiment for a body suit of the present invention having optional spinal supports inserted therein;

FIG. 7A is a front elevational view of an optional spinal support member insertable within the body suit of the present invention;

FIG. 7B is a rear view of a body suit having optional spinal supports inserted therein;

DETAILED DESCRIPTION OF THE PRESENT INVENTION

Figure 1:
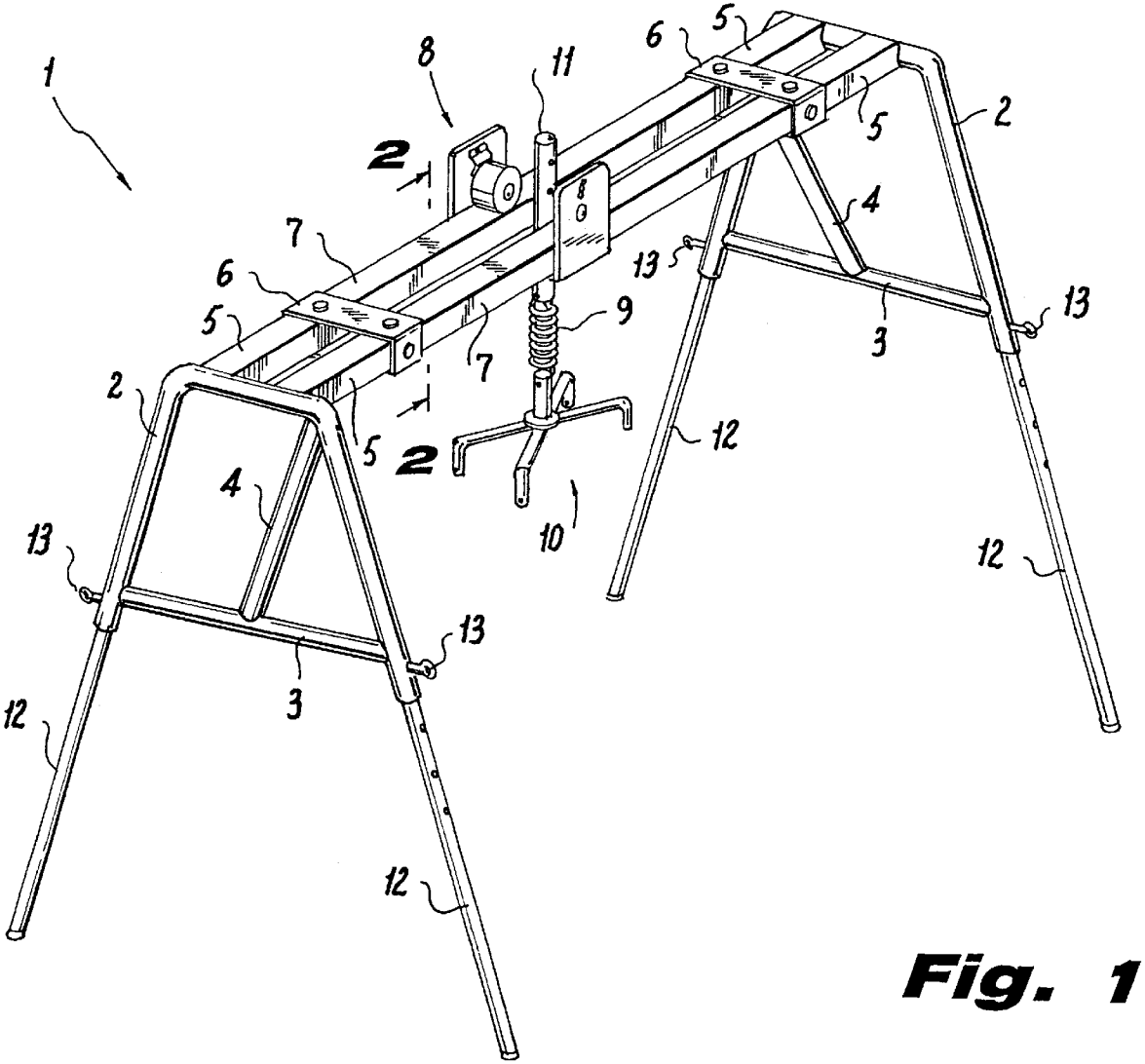
FIG. 1 is a perspective view of a support track apparatus of the present invention intended for home use.

The frame 1 of the gliding support device of the present invention shown in FIG. 1 is intended for home use. As such, it is constructed of lightweight steel or aluminum tubing with features for ease of transporting and assembly.

Although many different structural configurations are applicable, in the preferred embodiment, the two top end sections are pre-assembled and include welded parts for maximum rigidity. They each have a bent tubing member 2, cross brace 3, rail end extensions 5, rail attachment member 6 and angled brace 4. The structure is completed by adding rails 7 and legs 12 which have a telescopic fit in end sections 2 and are adjustable for height with the aid of spring pins 13 which fit in the desired adjustment hole. A trolley subassembly 8 completes the home support track.

Figure 1A:
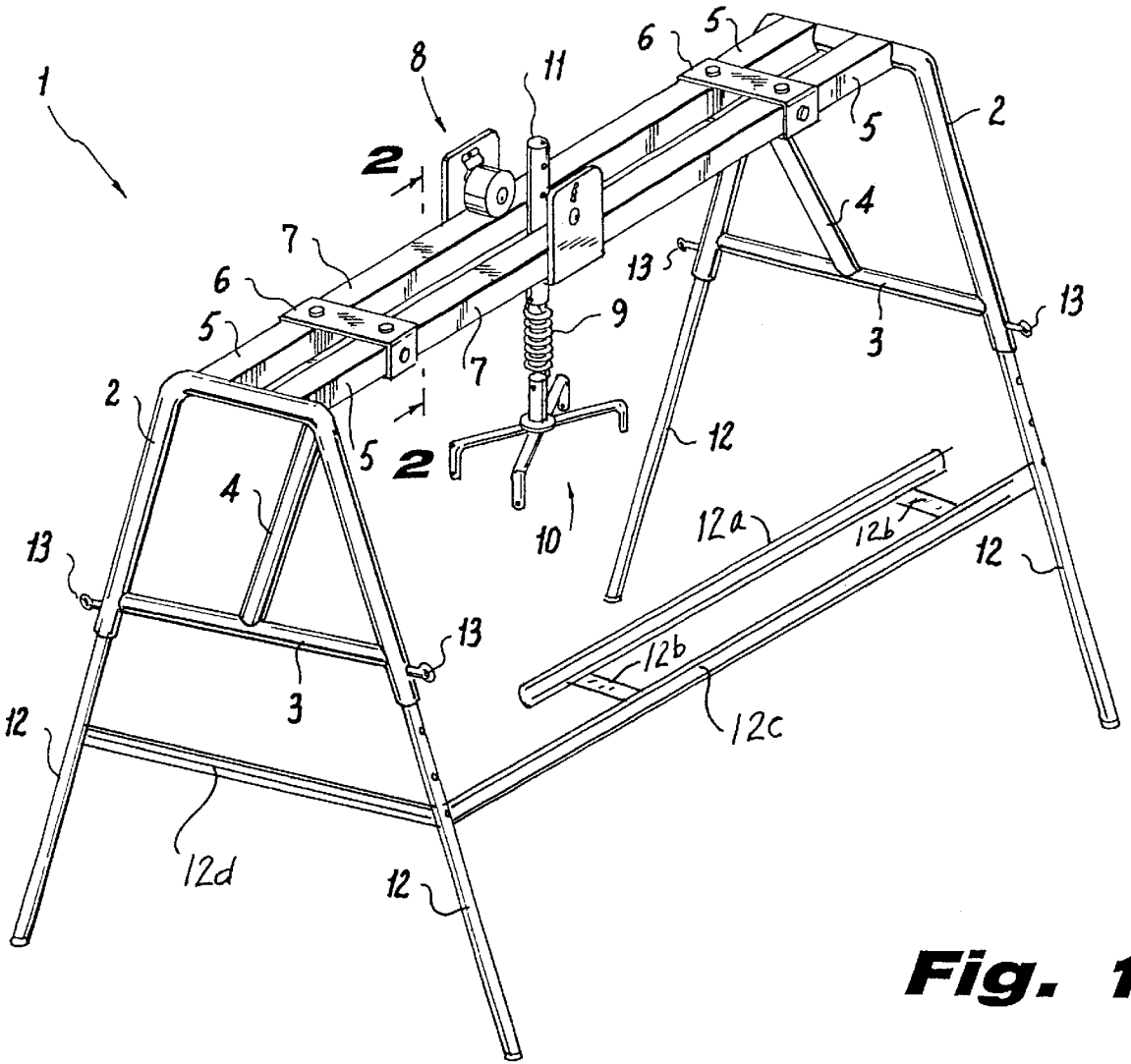
FIG. 1A is a perspective view of an alternate embodiment for a support track having optional pull bars extending therefrom.
Figure 1B:
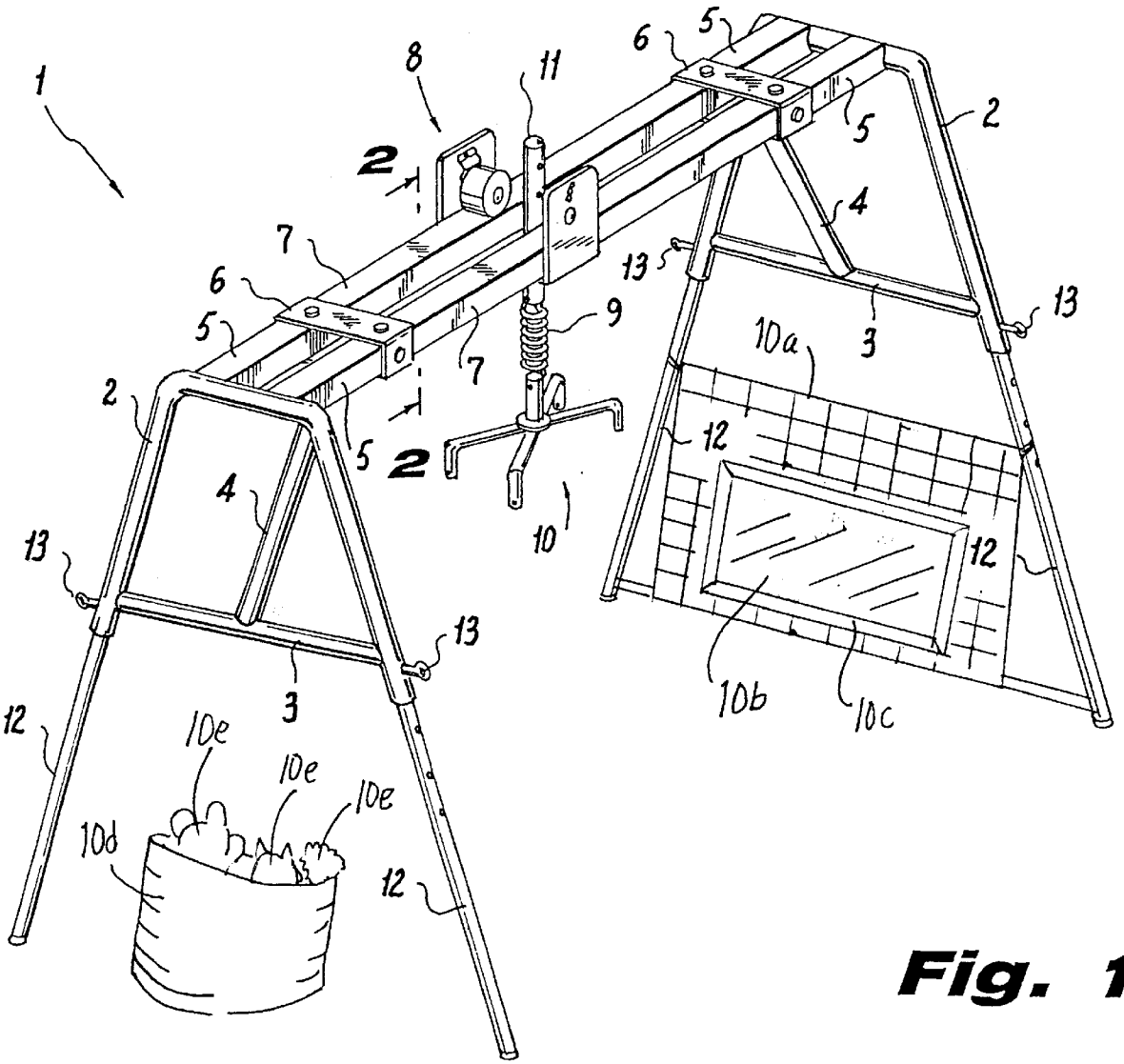
FIG. 1B is a perspective view of another alternate embodiment for a support track having optional sensory attractive items, associated therewith.

FIGS. 1A and 1B disclose optional visually and/or tactilely sensory attractive targets, such as pull bars 12*a* shown in FIG. 1A, or a net 10*a*, mirror 10*b* or toys 10*e* shown in FIG. 1B, to enhance the movement strategies of the developmentally delayed person, or the physically or neurologically impaired person, being helped. These sensory attractive targets 10*a*, 10*b*, 10*c* or 12*a* give an incentive to the person to advance further ahead along a path.

Pull bars 12*a* of FIG. 1A optionally extend either directly between support frame members 12, or else extend from by brackets 12*b* connected to pull bar supports 12*c* from support frame members 12. Pull bars 12*a* enable the person to manually grasp pull bar 12*a* to advance forward, backward or sideways along a path of movement. Pull bars 12*a* also increase muscle strength by enabling the person in pulling towards or away from pull bar 12*a*.

For persons with ascertainable vision, FIG. 1B shows sensory attractive targets which are visually attractive, such as mirror 10*b* or toys 10*e*.

For visually impaired persons, the sensory attractive targets may be tactilely attractive items, irrespective of sight, such as soft toys 10*e* or arrays of netting 10*a*, having a texture and tactile arrangement that can be manually grasped at the completion of a journey ahead. Therefore, the visually impaired person can learn that the tactilely attractive item, such as the netting 10*a* or toy 10*e*, is several crawling steps ahead from a predetermined starting point of travel, without having to visually observe netting 10*a* or toys 10*e* normally seen by a sighted person.

While tactilely attractive netting 10*a* is shown in FIG. 1B connected to support frame members 12, tactilely attractive toys 10*e* are shown in FIG. 1B spaced apart from frame 2, but associated therewith by being placed in a nearby toy container 10*d*.

To enhance safety, pull bars 12*a* or mirror frame 10*c*, holding mirror 10*b*, may be covered with a soft material, such as, for example, polyurethane foam, plush cotton or other soft cushiony natural or synthetic materials, or may be coated with a soft coating cushion known to those skilled in the art.

Figure 2:
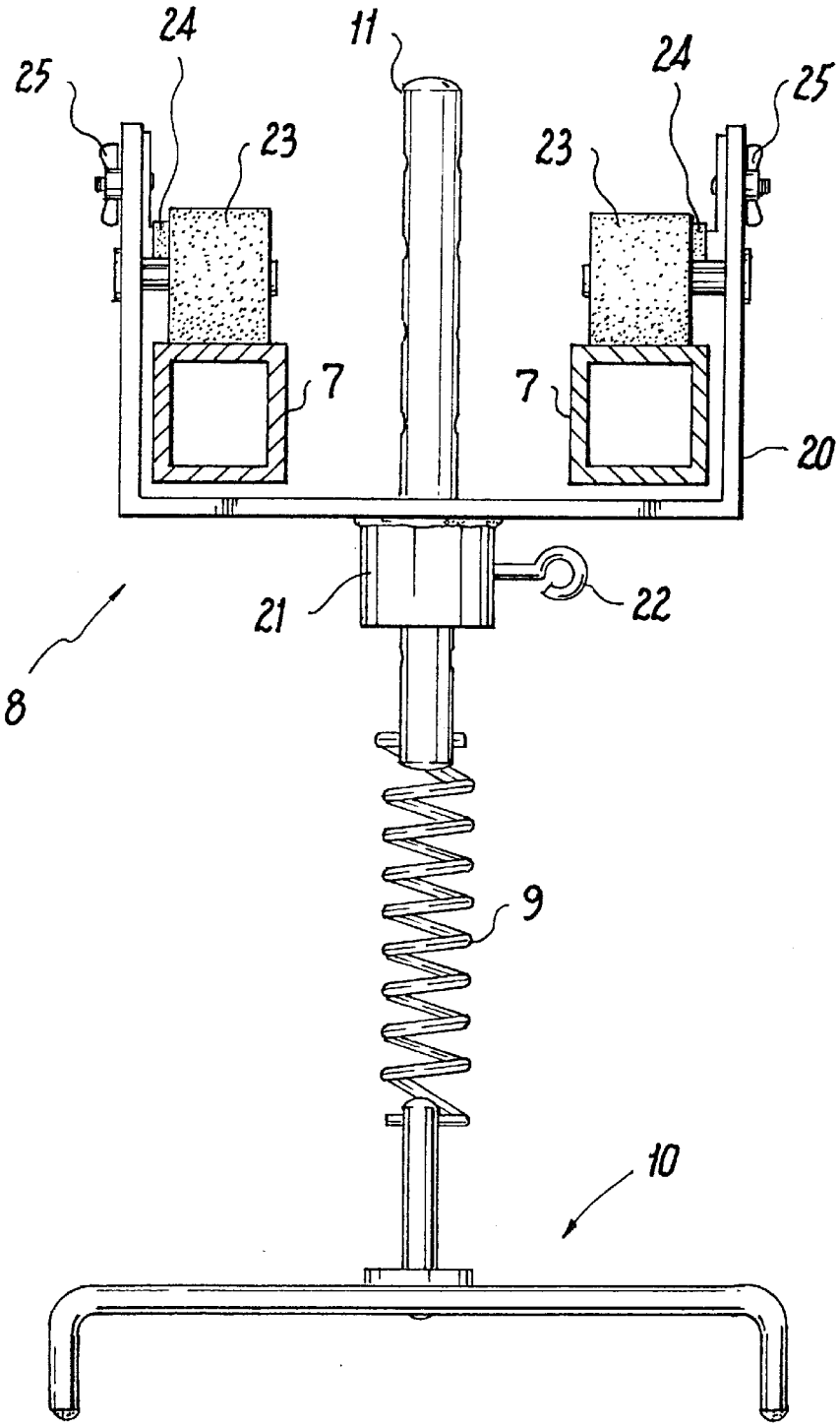
FIG. 2 is an end view of a support trolley of the present invention for a home system.

FIG. 2 shows details of trolley 8 including frame 20, support rollers 23 (which roll on the top surface of rails 7), adjustable height rod 11, collar 21, and spring pin 22 for adjusting height.

Also included is an adjustable drag feature, which includes brake pads 24, mounted on short lengths of leaf spring. The pressure of pads 24 against the inner side of rollers 23 can be adjusted from no contact to a preset maximum by adjusting wing nut 25.

Since the rollers 23 have ball bearings, for certain stages in child development and for certain exercises, the momentum of suspended person, such as a child or adult, can be disconcerting if high speeds are achieved. This drag adjustment can control the maximum speed and also the amount of effort required for the person, such as a child or adult, to move. This latter factor can be used in supervised settings to improve exercise effort.

An extension spring 9 is used to suspend attachment arms 10, which will be used to attach the person's body suit straps. Arms 10 can rotate freely at the bottom spring 9 attachment.

Figure 3:
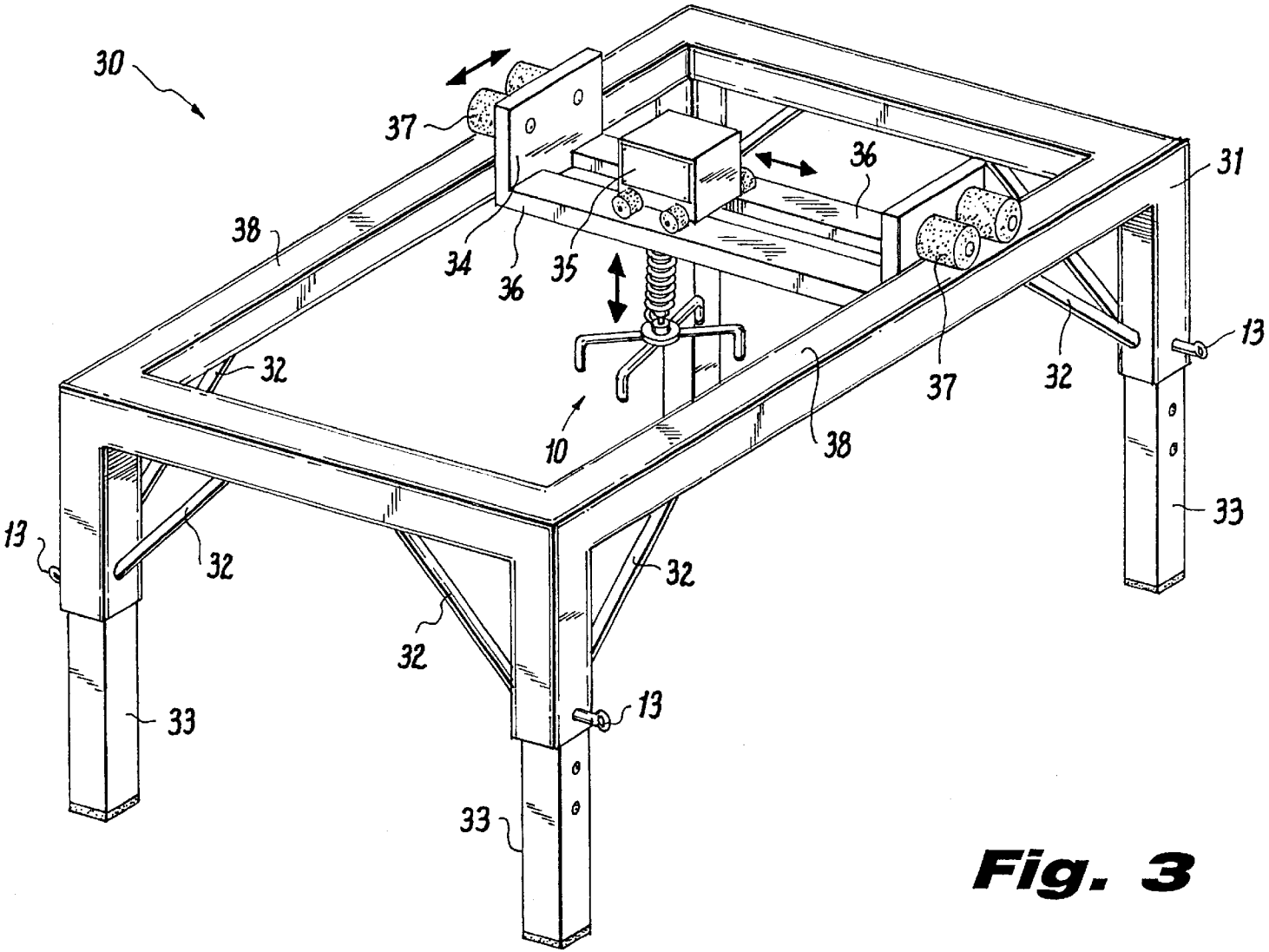
FIG. 3 is a perspective view of support track apparatus of the present invention for a therapy center.

FIG. 3 shows an alternate embodiment of the support track apparatus for a health center or a therapeutic center. The physical size as well as the structural strength is superior to the home version. This apparatus can also be used for rehabilitation of adults with a variety of injuries such as spinal surgery recovery.

Frame 31 includes square metal structural tubing with angled braces 32. Telescoping bottom leg sections 33 are used to adjust frame height by using spring pins 13 in appropriate adjustment holes. The top surfaces 38 of longitudinal members are used to support the rollers 37 of a gantry carriage 34 with cross rails 36. Trolley subassembly 35 rolls on rails 36. The suspension arms 10 can be positioned over any spot within the contours of frame 31 through the combination of longitudinal rolling on surfaces 38 and crosswise rolling on rails 36. Mechanical stops (not shown) can be clamped onto rails 36 or 38 to limit the travel in either orthogonal direction as desired.

Figure 4:
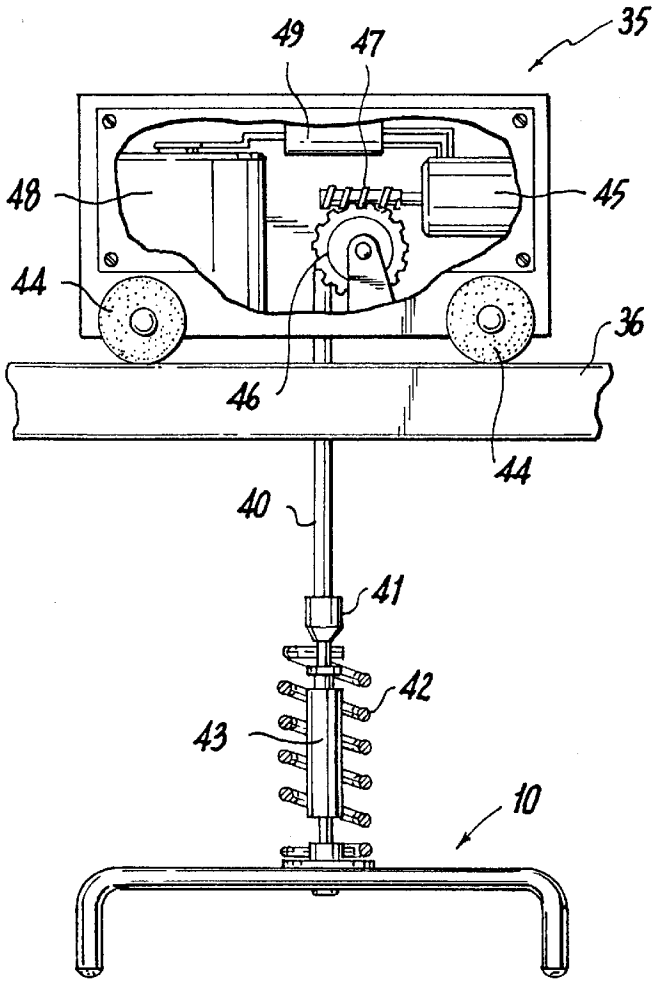
FIG. 4 is a side view of support trolley subsystem of the present invention with the cover shown removed.

FIG. 4 is a side view of trolley subassembly 35 with the access panel removed to show the components within. Rollers 37 as well as rollers 44 can be equipped with adjustable drag brakes (not shown) as discussed for the previous embodiment. Trolley 35 is equipped with a remote controlled electric winch to raise or lower attachment arms 10.

Figure 5:
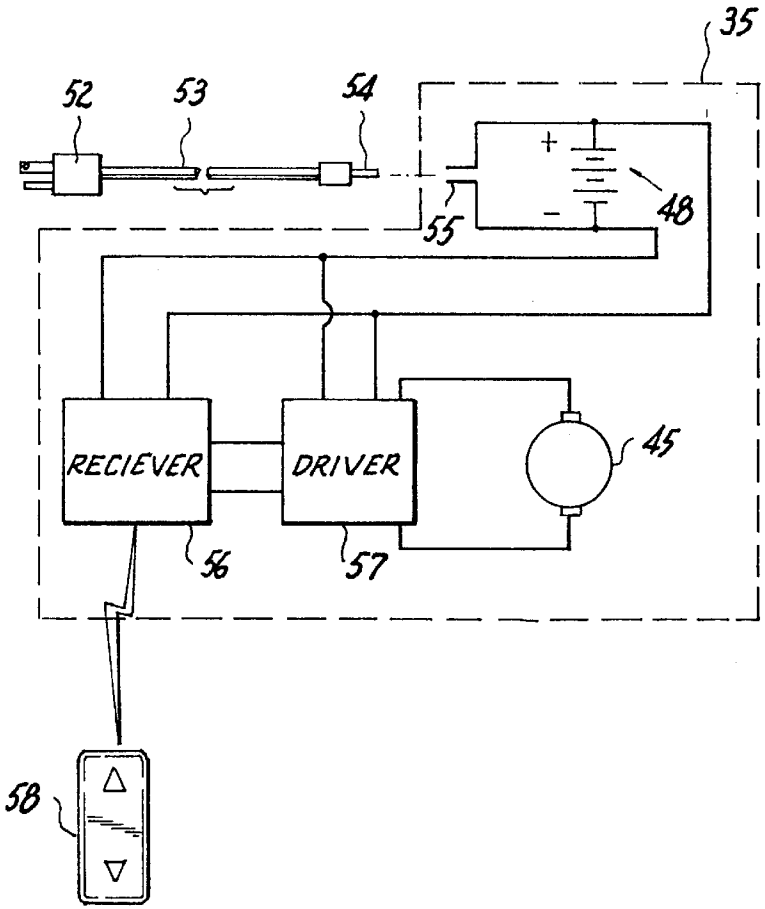
FIG. 5 is an electrical block diagram support trolley subsystem of the present invention.

FIG. 5 is an electrical block diagram of this subassembly. The winch consists of drum 46 with spur gear engaging worm pinion 47 driven by gear motor 45. The worm 47 pitch is selected to prevent overrunning so that cable 40 cannot be pulled out further once motor 45 has stopped. A rechargeable battery 48, similar to nickel cadmium types used in industrial portable drills, supplies power to receiver/driver 49 which, in turn, controls and powers motor 45.

A wall mounted battery charger 52 is plugged into socket 55 during non-use hours to recharge battery 48 (e.g.—over night). A long cord 53 is used to facilitate this. A radio frequency communications protocol is used from remote control 58 to receiver 56 so that the therapist's eyes need not be moved from the patient during height adjustment.

Remote control 58 has only two buttons, UP and DOWN. If an infrared control link were used as in TV remote controls, a general line of sight aiming would have to be used. The radio frequency link is Omni-directional and is not impaired by structural members that would interfere with an infrared signal.

Driver 57 spins motor 45 in the desired direction upon command from remote control 58 to raise or lower cable 40. Cable ferrule 41 has a loop to accept extension spring 42 as well as concentrically located adjustable damping element 43, which can either be a pneumatic dashpot or a hydraulic shock absorber. These velocity sensitive elements are used to adjust the amount of "bounce" as desired. Bounce is often used as an incentive to initiate movement, but too much bounce can cause injury.

Figure 7:
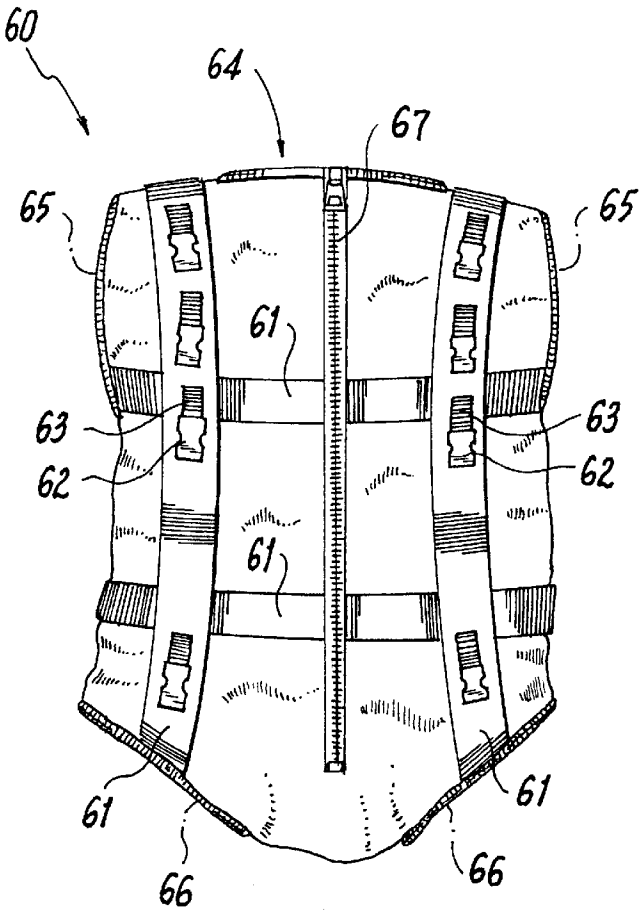
FIG. 7 is a rear view of body suit of the present invention.
Figure 6:
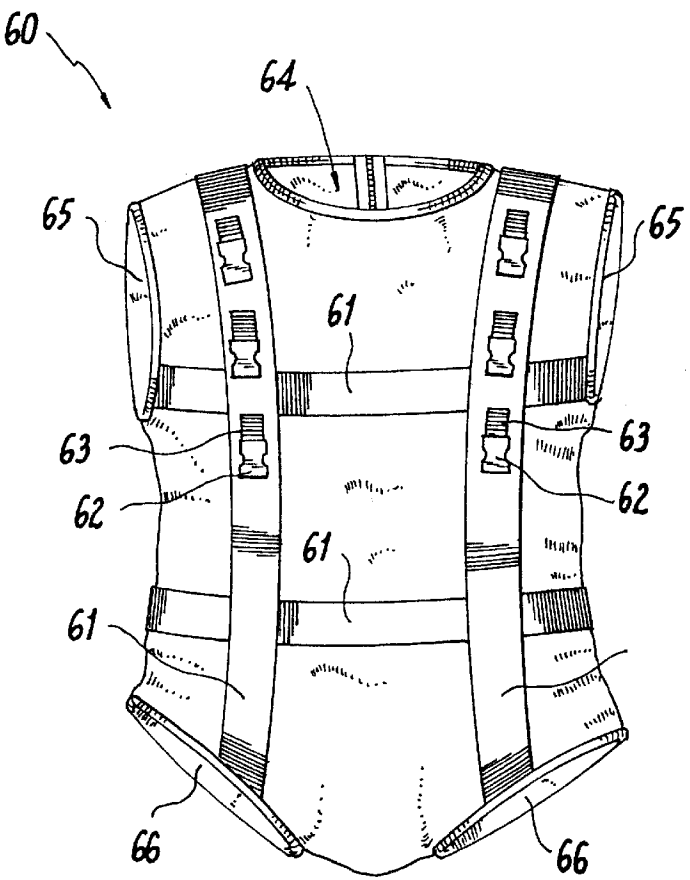
FIG. 6 is a front view of body suit of the present invention.

FIGS. 6 and 7 show the front and back of body suit 60 respectively. It is made of sturdy machine washable cotton fabric and is a custom fit for the child or adult. A zipper 67 opens the back for easy donning and removal. Reinforcing webbing 61 is added where the sturdy connector clips 62 are fastened with their own webbing tabs 63.

Depending on the size of body suit 60, the middle pair of clips 62 on the front and the back may be eliminated if the spacing is too constrained. Also there may be no lower pair of front clips (as on the back side) since these would cause a danger of toppling if used.

The lower back pair is only used for the creeping or "quadruped" position. The upper clips 62 on the front and back are used to position for sitting, kneeling or standing positions. The neck opening 64, arm holes 65 and leg openings 66 complete the design which distributes the point stresses of straps attached to clips 62 over a large area.

FIGS. 6A, 7A and 7B show that body suit 60 may have optional longitudinally extending spinal supports 67 or 68 inserted within built-in pocket sleeves 69 extending along body suit 60, to assist the person in staying erect or in a quadruped position, once the person has achieved an erect or quadruped position. The spinal supports may be of various sizes, such as long spinal supports 67 shown in FIG. 7A, or short spinal supports 68 shown in FIG. 7B.

Figure 8:
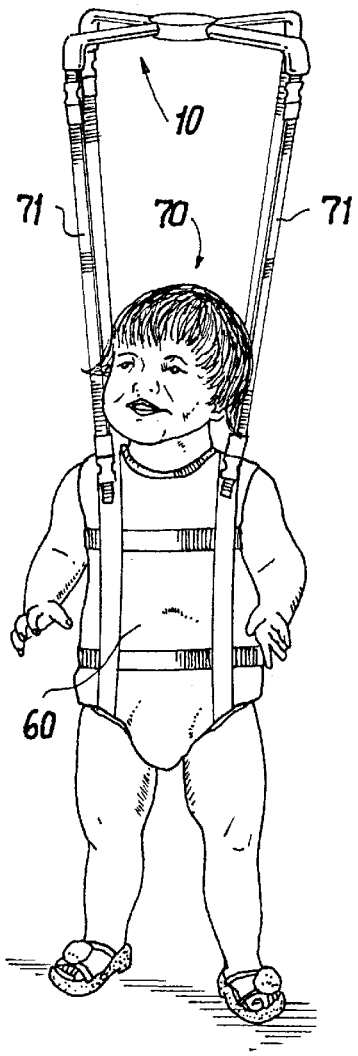
FIG. 8 is a front view of a standing child using the present invention.

FIG. 8 shows a person 70, such as a child, wearing body suit 60 suspended by straps 71 attached to support arms or frame 10. The suspension is similar to that used by a marionette. Straps 71 are of nylon webbing with length adjuster buckles (not shown) or if more "bounce" is desired, an elastic material may be used for straps 71.

Figure 9:
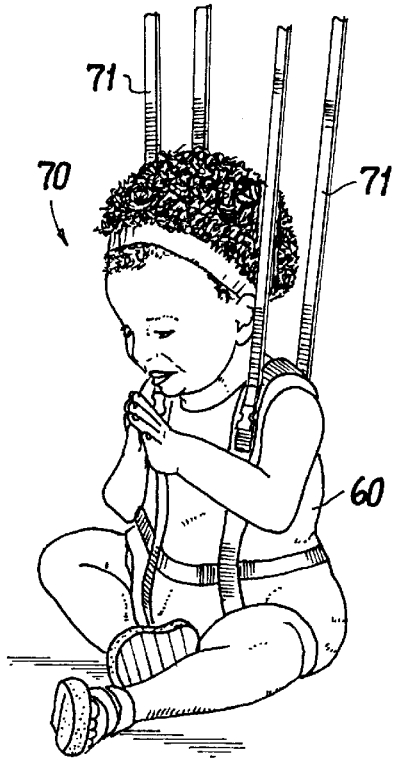
FIG. 9 is a rear view of sitting child using the present invention.

FIG. 9 shows child 70 in a suspended seating position.

Figure 10:
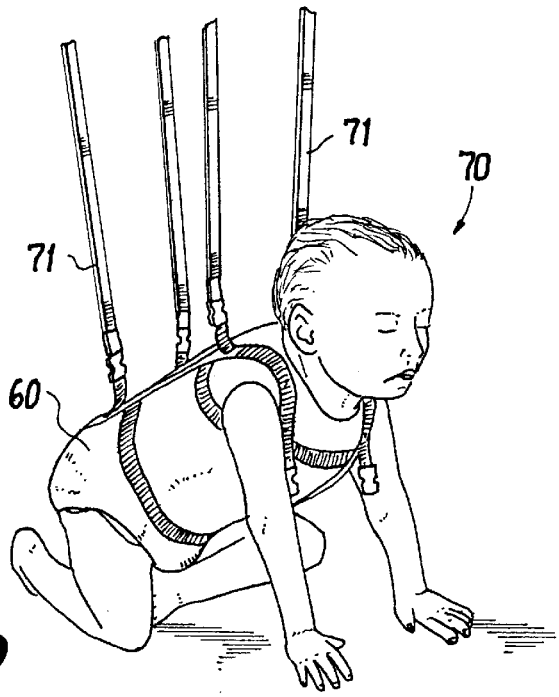
FIG. 10 is a side view of crawling child using the present invention.

FIG. 10 shows the use of the back attachments to support the child in a creeping position.

Figure 11:
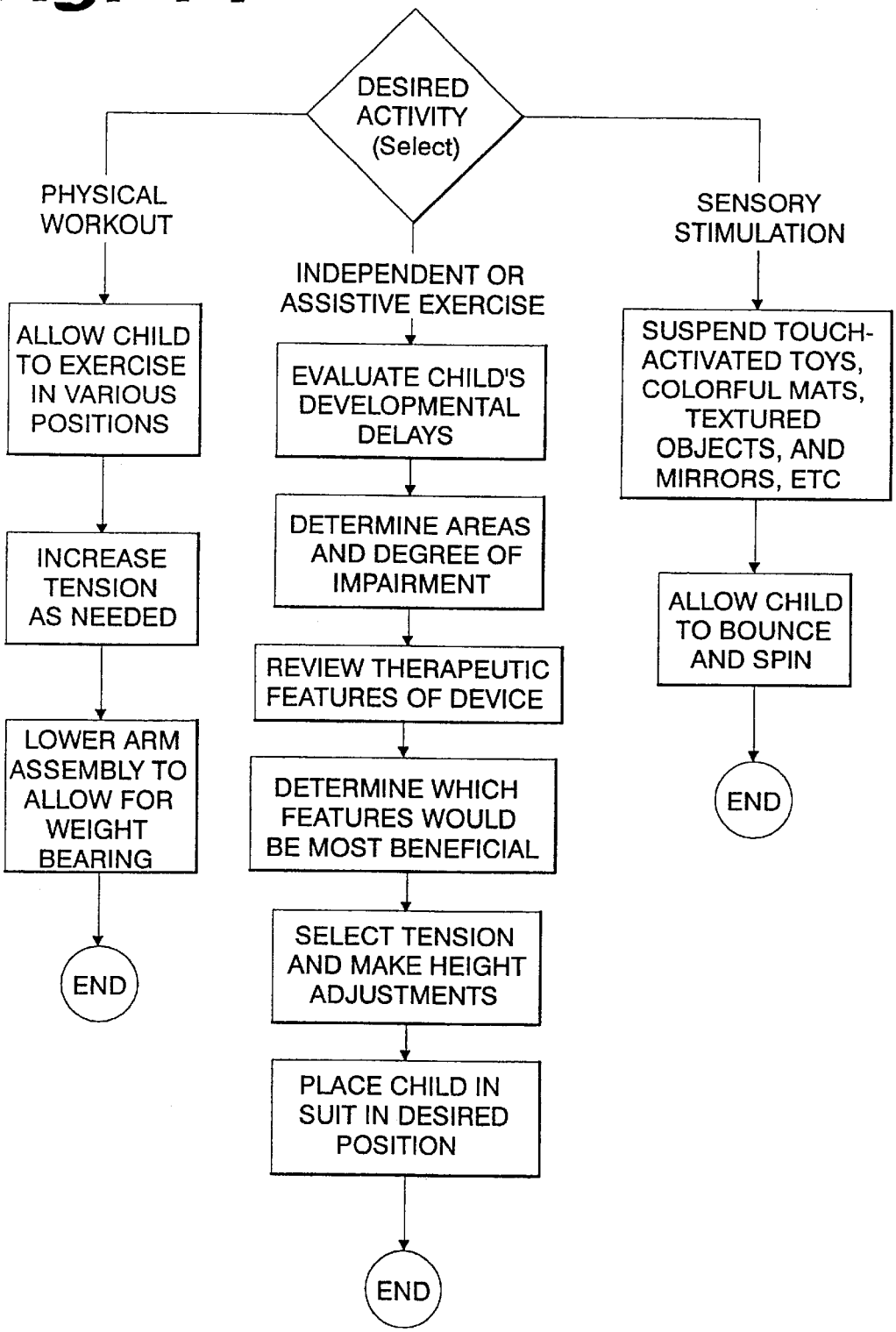
FIG. 11 is a flowchart illustrating modes of use for the apparatus of the present invention.

FIG. 11 shows a flow chart of the method of the present invention.

Figure 12:
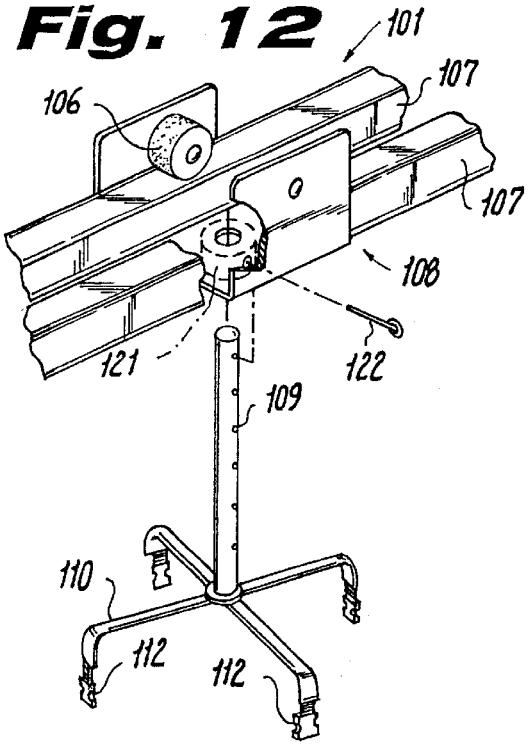
FIG. 12 is a perspective view of an alternate embodiment for a non-rotating arm assembly of the present invention.

FIG. 12 shows a portable suspension frame 101 having attached at the top a pair of rails 107 along which support trolley 108 rolls back and forth on trolley wheels 106. In turn, support extension 109 extends downward from height adjustment collar 121 attached to support trolley 108, with height adjustment pin 122 securing support extension 109 at a desired height so as regulate the height of frame hanger 110 attached to support extension 109 at the bottom end thereof.

Frame hanger 110 is attached to the bottom of support extension 109. Frame hanger 110 has a plurality of downwardly extending strap restraints 112, which may be buckles, snap closures, or other suitable fastening means for straps to be hung therefrom.

Figure 13:
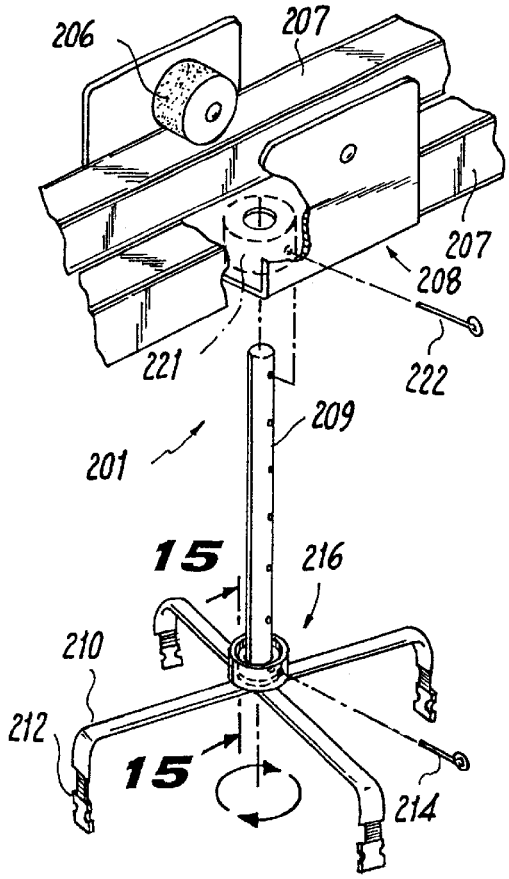
FIG. 13 is a perspective view of a second alternate embodiment for a rotating arm assembly with a locking feature of the present invention.

FIG. 13 shows portable support frame 201 that is similar to that of support frame 101 shown in FIG. 12, but FIG. 13 has swivel collar 216, with removable securing pin 214, allowing support extension 209 to rotate. Support trolley 208 rolls on trolley wheels 206 along rails 207. Support trolley 208 is attached to downwardly extending support extension 209 by means of height adjustment collar 221 having height adjustment securing pin 222 to fix the height of support trolley 208 at a desired level on support extension 209.

Frame hanger 210 is rotatably attached to support extension 109 by swiveling collar 216 with removable locking pin 214. Frame hanger 210 has a plurality of downwardly extending strap restraints 212, which may be buckles, snap closures, or other suitable fastening means for straps to be hung therefrom.

Figure 14:
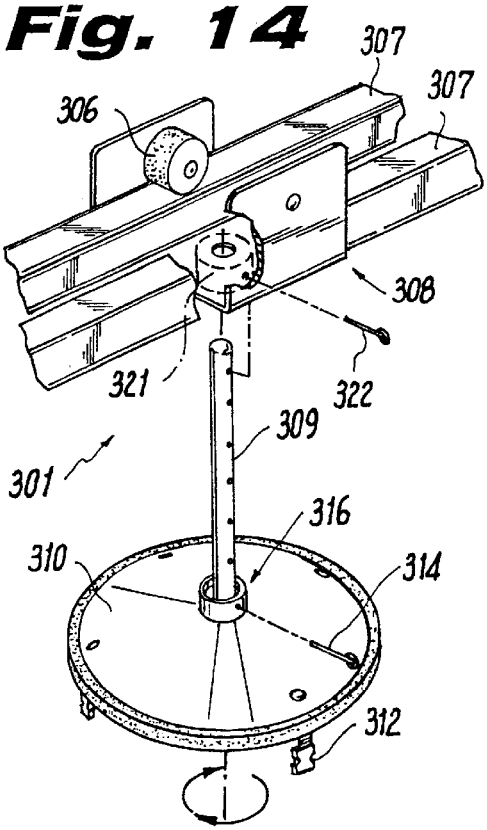
FIG. 14 is a perspective view of a third alternate embodiment for a disk-mounted arm assembly of the present invention.

FIG. 14 shows suspension frame 301 having a support trolley 308 having a pair of rails 307 similar to the structures shown in FIGS. 12 and 13. In FIG. 14 support trolley 308 rolls along rails 307 by means of trolley wheels 306. Support trolley 308 is in turn attached to downwardly extending support extension 309 by height adjustment collar 321 with height adjustment pin 322 fixing support trolley 308 in position relative to support extension 309.

At the bottom end of support extension 309 hanger disk 310 is a round-shaped member having a plurality of strap restraints 312 downwardly extending therefrom, which strap restraints 312 may be buckles, snap closures, or other suitable fastening means for straps to be hung therefrom.

Hanger disk 310 is rotatably attached to the bottom of support extension 309 by swiveling collar 316 and locking pin 314.

Figure 15:
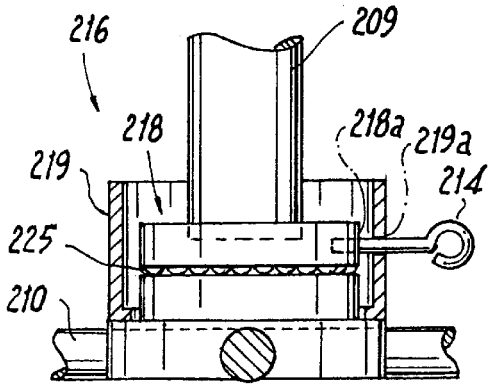
FIG. 15 is a cross sectional view of the locking bearing for the assembly as in FIG. 13.

FIG. 15 shows a cut-away detail of the attachment of support extension 209 of frame 201 at its attachment to swiveling collar bearing 216 with locking pin 214 as shown in FIG. 13, along lines 15—15 therein. Swiveling collar 216 is comprised of inner collar 218 having locking aperture 218*a* for accepting locking pin 214. Outer collar 219 fits around inner collar 218, and outer collar 219 has locking aperture 219*a*, which, when in positional register with aperture 218*a*, permits insertion of locking pin 214 so as to lock inner collar 218 to outer collar 219. Rotation is permitted by ball bearings 225.

Figure 16:
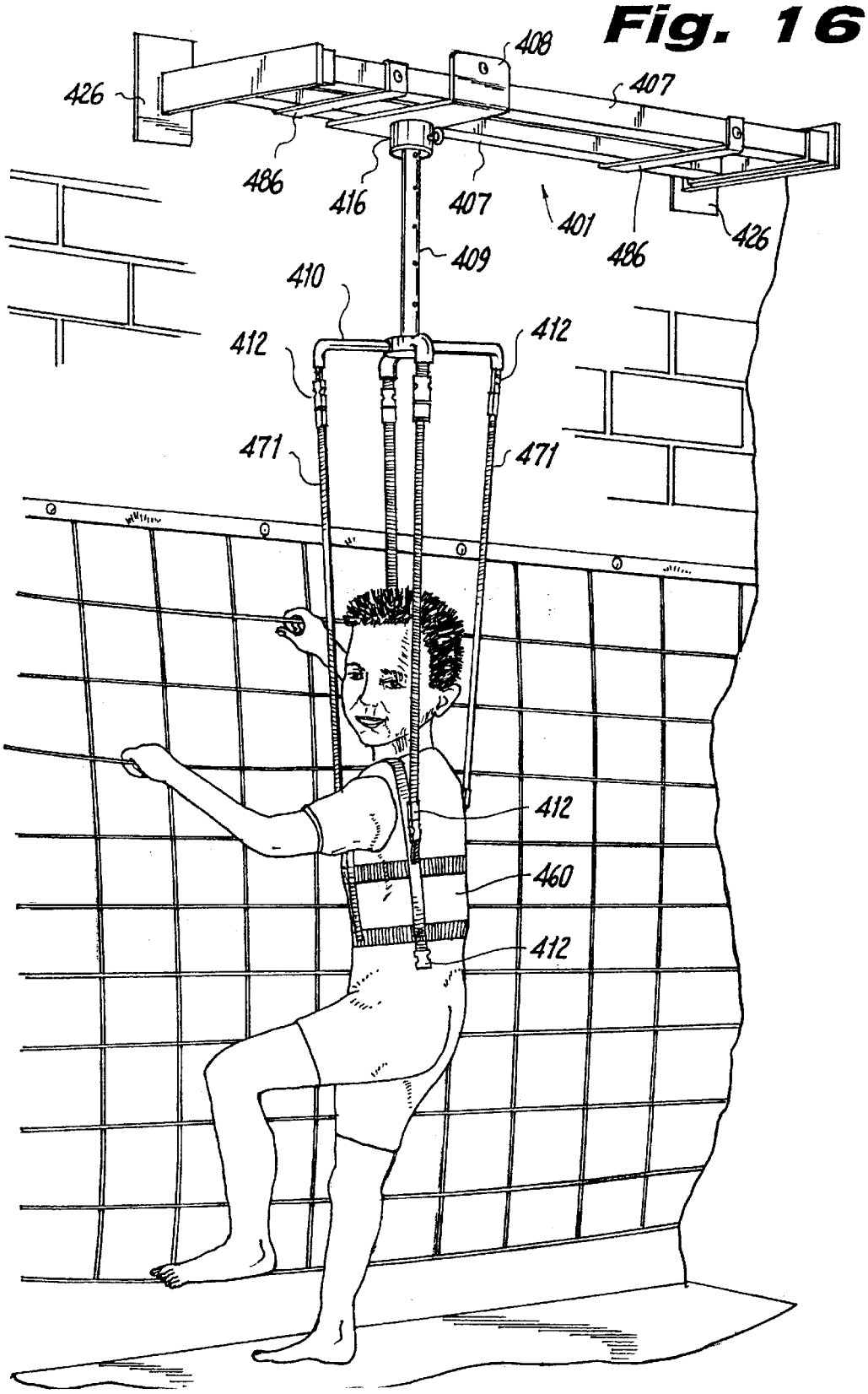
FIG. 16 is a perspective view of a fourth embodiment for a wall-mounted unit of the present invention.

FIG. 16 shows a wall-mounted support frame embodiment 401 of the present invention having a support trolley 408 having a pair of rails 407 similar to the structures shown in FIGS. 12 and 13. In FIG. 16 support trolley 408 rolls along rails 407 by means of trolley wheels 406. Support trolley 408 is in turn attached to downwardly extending support extension 409 by height adjustment collar 421 with height adjustment pin 422 fixing support trolley 408 in position relative to support extension 409. A pair of stop plates 426 at either end of rails 407 serve to arrest the motion of support trolley 408 at the respective ends of its travel and stop plates 426 also serve as wall mounting brackets. Rail braces 486 maintain rails 407 in spaced apart position relative to each other.

Frame hanger 410 extends outwardly from its attachment at the bottom of support extension 409. Frame hanger 410 has a plurality strap restraints 412 downwardly extending therefrom, which strap restraints 412 may be buckles, snap closures, or other suitable fastening means for straps to be hung therefrom. Straps 471 extend downward from strap restraints 412 and attach to strap restraints 412 on body suit 460, so as to position a person with desirable support for therapy.

Figure 17:
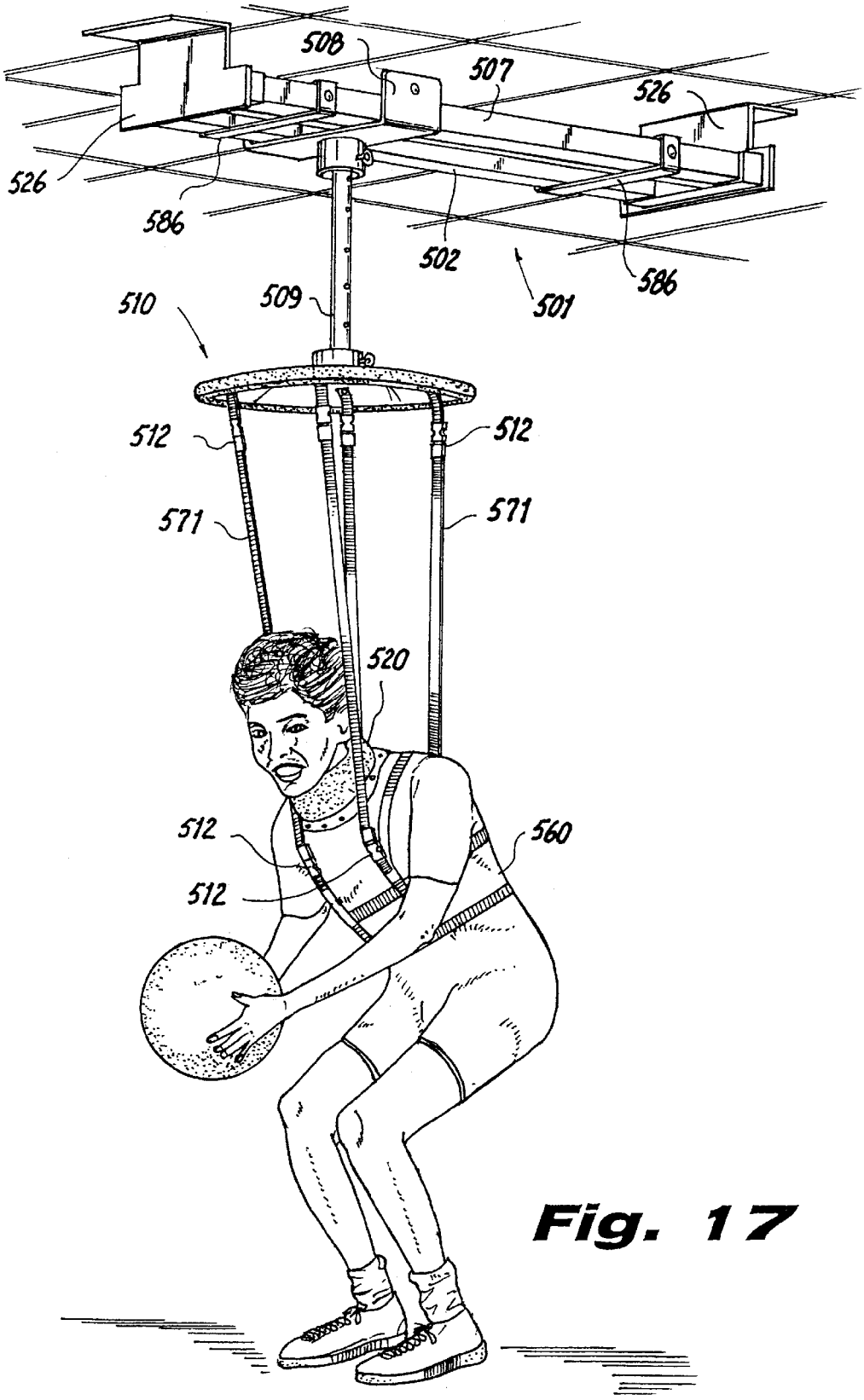
FIG. 17 is a perspective view of a fifth alternate embodiment for a ceiling-mounted support track apparatus of the present invention.

FIG. 17 shows a ceiling-mounted support frame embodiment 501 of the present invention having a support trolley 508 having a pair of rails 507 similar to the structures shown in FIGS. 12 and 13. In FIG. 17 support trolley 508 rolls along rails 507 by means of trolley wheels 506 [not shown]. Support trolley 508 is in turn attached to downwardly extending support extension 509 by height adjustment collar 521 with height adjustment pin 522 fixing support trolley 508 in position relative to support extension 509. A pair of stop plates 526 at either end of rails 507 serve to arrest the motion of support trolley 508 at the respective ends of its travel and stop plates 526 also serve as ceiling mounting brackets. Rail braces 586 maintain rails 507 in spaced apart position relative to each other.

Frame hanger 510 is shown as a disk but may be a frame as shown in FIG. 16. As shown in FIG. 17, disk hanger 510 extends outwardly from its attachment at the bottom of support extension 509. Disk hanger 510 has a plurality strap restraints 512 downwardly extending therefrom, which strap restraints 512 may be buckles, snap closures, or other suitable fastening means for straps to be hung therefrom. Straps 571 extend downward from strap restraints 512 and attach to additional strap restraints 512 on body suit 560, so as to position a person, such as a child or adult, with desirable support for therapy. FIG. 17 depicts a supported child wearing optional cervical collar 520, to stabilize the head and neck during movement of the person within body suit 560.

Figure 18:
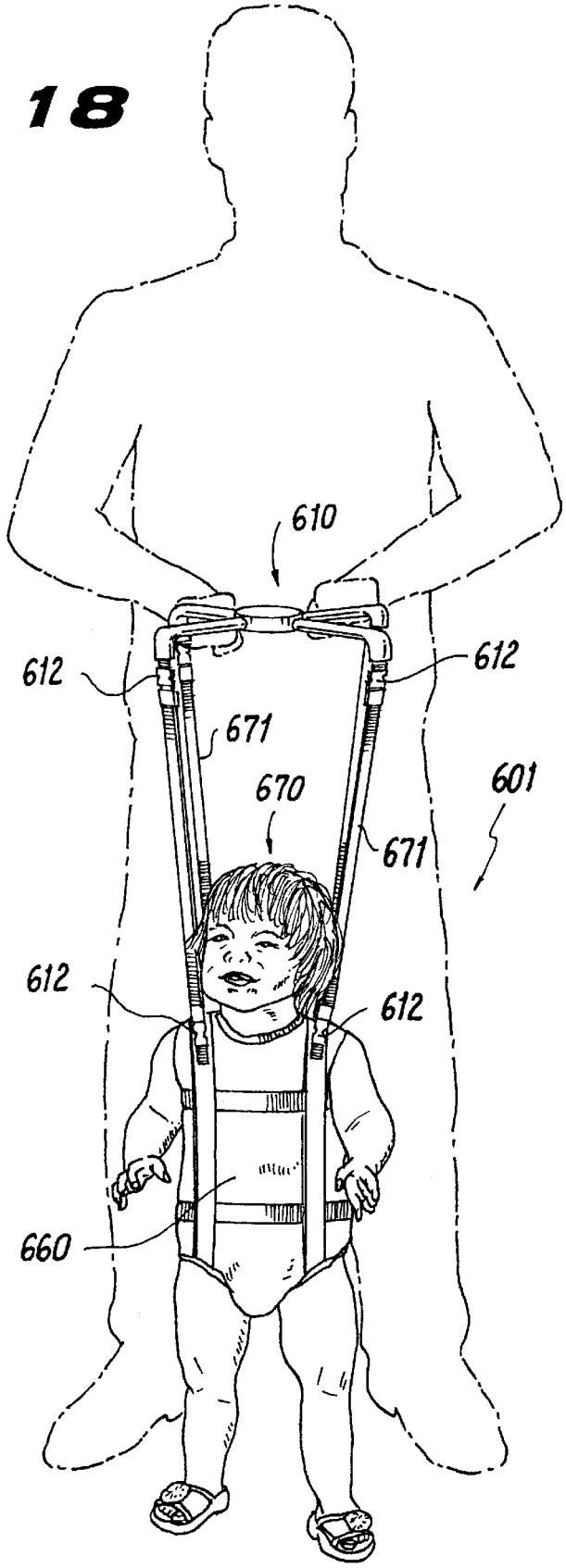
FIG. 18 is a front view of a sixth alternate embodiment for a handheld system with a grasping suspension frame for supporting a standing child using the present invention.

FIG. 18 shows hand-held frame embodiment 601 having hand-held frame hanger 610 that in turn has a plurality strap restraints 612 downwardly extending therefrom, which strap restraints 612 may be buckles, snap closures, or other suitable fastening means for straps to be hung therefrom. Straps 671 extend downward from strap restraints 612 and attach to strap restraints 612 on body suit 660, so as to position a person, such as a child or adult, with desirable support for therapy.

Figure 19:
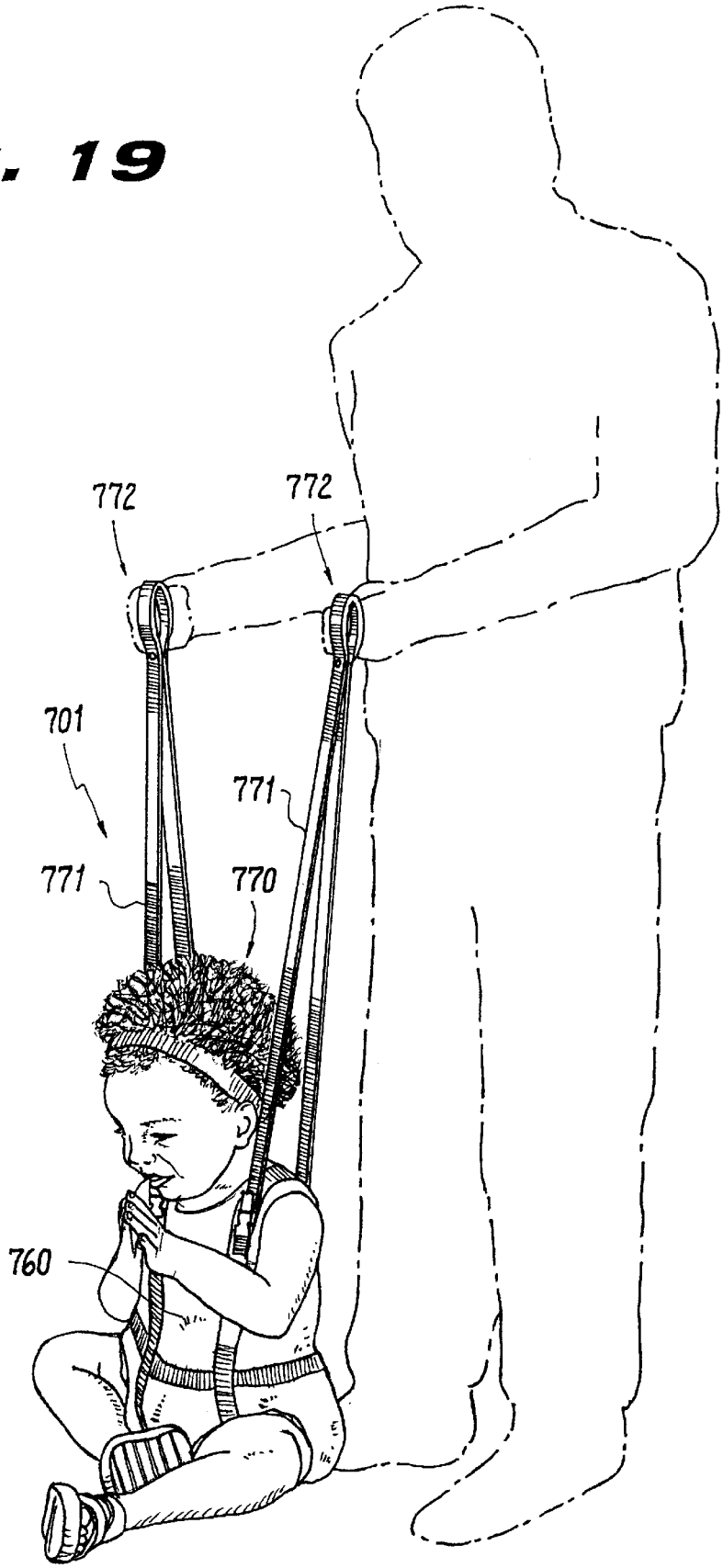
FIG. 19 is a perspective view of a seventh alternate embodiment for a handheld system having grasping suspension loop strap handles for supporting a sitting child using the present invention; and, FIG. 20 is a side view of seventh alternate embodiment having a grasping suspension bar comprising a handheld system for supporting a crawling child using the present invention.

FIG. 19 shows frame support embodiment 701 having a pair of hand-held strap loop handles 772 from which a plurality of straps 771 extend downwardly therefrom. Straps 771 in turn attach to strap restraints 712 on body suit 760, so as to position a person, such as child 770, with desirable support for therapy.

Figure 20:
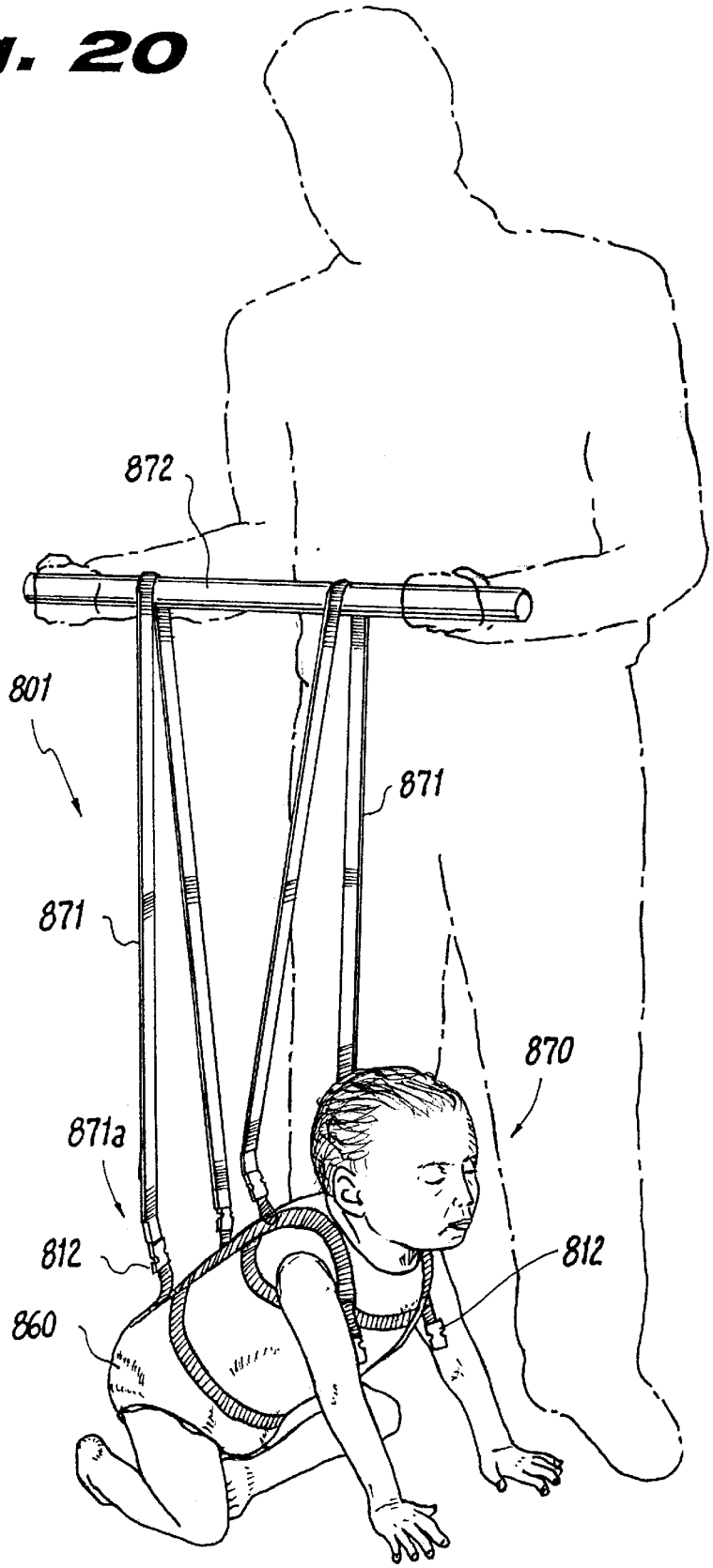

FIG. 20 shows hand-held frame support embodiment 801 having a graspable bar supporting a pair of hand-held strap loop handles 872 from which a plurality of straps 871 extend downwardly therefrom. Straps 871 in turn attach to strap restraints 812 on body suit 860, so as to position a child 870 with desirable support for therapy. At least one strap restrain 812 on body suit 860 is attached in the area of the hips of child 870 so as to position a child 770 with desirable support for crawling and creeping.

Figure 21:
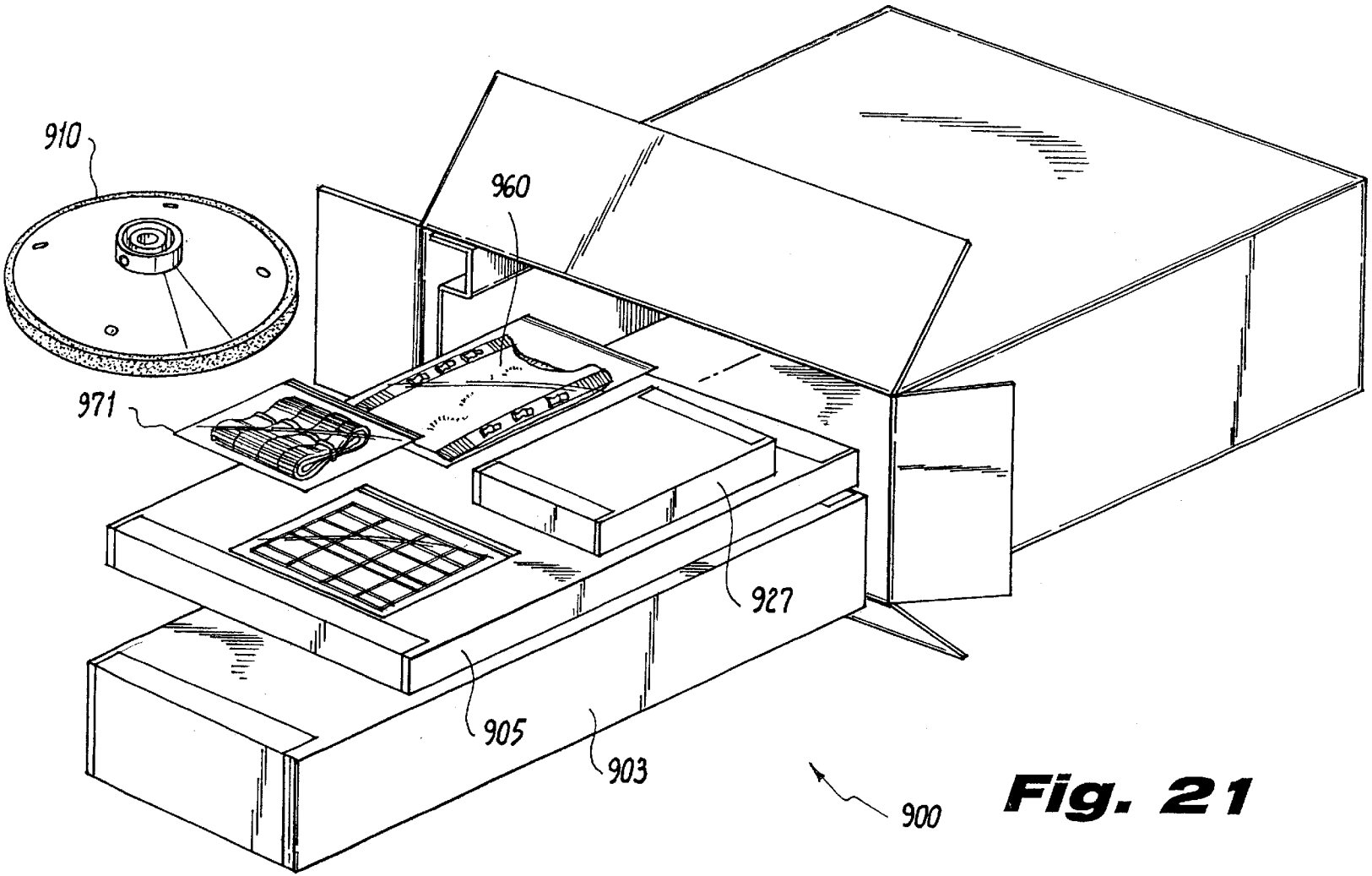
FIG. 21 is a perspective view of a kit used with the preset invention.

FIG. 21 shows a kit 900 for a support frame embodiment with convenient packaging including receptacle 903 for support frame members, as well as visually attractive target members, such as mirror 905 or activity net 929 to hold toys. Lit 900 also optionally includes disk hanger 910, straps 971, body suit 960 or toy box 927. Mirror 905 is preferably a safety mirror with soft edges can be placed beyond one set of legs of a frame, such as legs 12 of frame 1 shown in FIG. 1, to attract the person, to advance forward when crawling. On the other hand, at the other end of frame 1, kit 900 can also include another visually attractive target member, such as activity net 929, which can be strung between two further legs 12 at an opposite end of frame 1, to hold toys from toy box 927, which might also attract the person's attention as an incentive to crawl towards the toys.

Figures 22, 23:
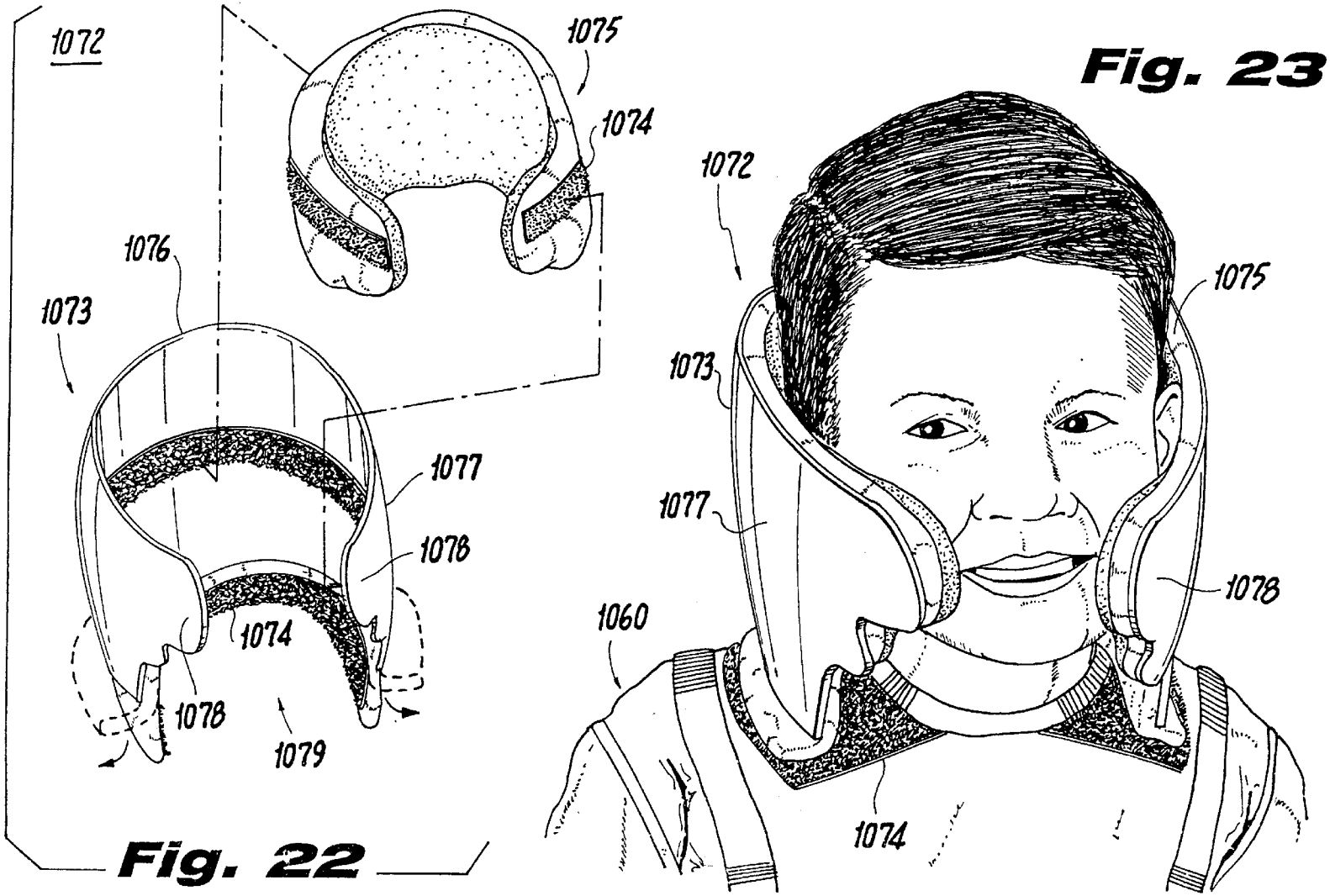
FIG. 22 is an exploded perspective view of a neck support collar used with the present invention.
FIG. 23 is a perspective view showing the neck support collar as in FIG. 22 being worn upon a person.

FIGS. 22 and 23 shows a neck support collar 1072 used and being worn upon a person who has not yet achieved head and trunk control. Collar 1072 provides additional support to the head and neck region of the person. Neck collar 1072 is attached to the body suit 1060 at an upper end thereof. With the additional support provided by neck collar 1072, the severely impaired person better controls head and trunk movements. Neck collar 1072 may be fabricated of foam or a similar material that would provide flexible support. The lower rim 1073 of the collar 1072 may also include a more rigid support such as a rubber or plastic reinforcement band which can add some rigidity to the collar 1072 yet still allow for flexibility. Collar 1072 is detachable and can be removed once strengthening as been achieved. The collar 1072 attaches to the suit 1060 at around the neck area by snap on fasteners or perhaps a hook and loop attachment 1074. In either case, the collar includes a removable casing that can be laundered. Similar to a pillow case and pillow, the outer case 1079 of the collar 1072 can be removed and washed preventing the foam inner support 1075 from damage due to wear and tear from use and cleaning. The attachment of the support collar 1072 to the suit 1060 can be a snap on fastener or a hook and loop closure. The shape of the collar 1072 can be horseshoe shaped. Its higher back extension 1076 prevents the person from hyper extending the neck backward but tapers down around the sides 1077 and to the front 1078 leaving an opening 1079 by the neck area to accommodate breathing or tracheostomy tubes or other obstructive medical prostheses.

Figures 24, 25, 26:
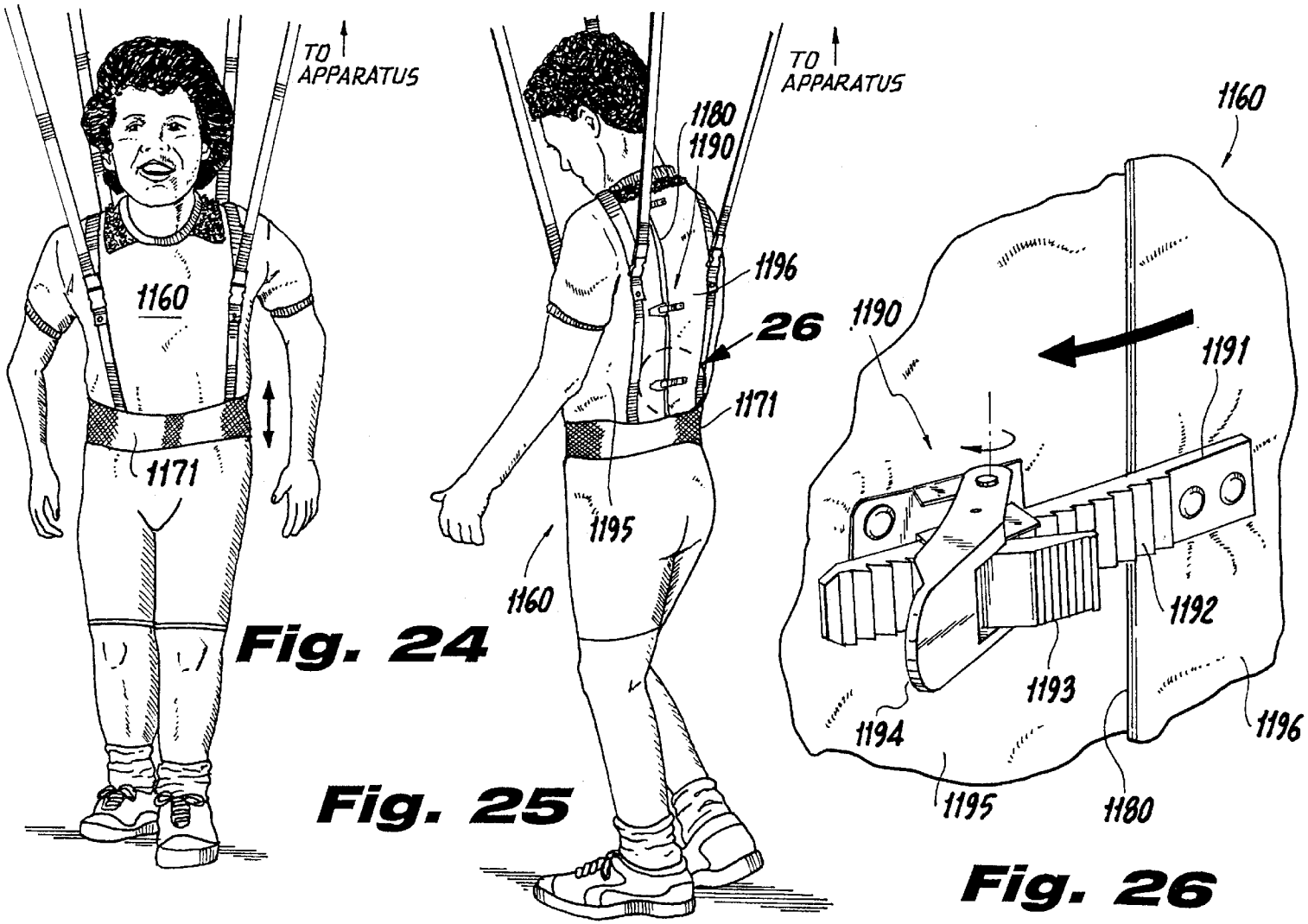
FIG. 24 is a front elevational view of an alternate embodiment for a height and girth adjustable body suit of the present invention, shown worn by a person.
FIG. 25 is a rear perspective view of the alternate embodiment for a height and girth adjustable body suit of the present invention, shown worn by a person; as viewed from the right side; and, FIG. 26 is a close-up detail view of the girth adjustment buckle thereof.

FIGS. 24–26 show an alternate embodiment for a height and girth adjustable body suit 1160, shown worn by a person; For height adjustment body suit 1160 has elastic, expandable belt 1171 to accommodate increase in growth of the person without having to replace the entire body suit. For sideways girth adjustment, body suit 1160 is seamed at seam 1180, which seam 1180 is closed by adjustable, teeth-geared, incremental fastener clasps 1190, having base 1191 with teeth gears 1192, intersected by tongue member 1193 attached to lever 1194, similar to fasteners used in roller blade footwear or ski bindings. Body suit 1160 is made up of quadrant portions 1195 and 1196, etc. both in the front and the rear which can be drawn together or distanced in order to adjust the suit 1160 to fit the user as the user grows in height and girth.

Furthermore, height adjustment can also be done with clasps 1190. In addition, girth can be alternatively done by elastic members (not shown) running vertically upon body suit 1160. The elastic material, such as a LYCRA or SPANDEX material, allows for both expansion when length increase is desired yet would also form a gathering when brought together to decrease distance between quadrants 1195 and 1196.

To adjust clasps 1190, one flips the fastener cover lever 1194 backward and into a locked position. To adjust size, the quadrants 1195 and 1196 are adjusted by selecting a position on the fastener and pulling the "tongue" tab through the fastener closure "tunnel" or by depressing the lever 1194 to cover the distance of quadrants 1195 and 1196 of body suit 1160. To adjust the suit width of body suit 1160, the same procedure is reversed by bringing the two rear sides together or apart and then selecting a position along the claps 1190 and locking them in place at the desired position.

Method of Use and Operation

FIG. 11 is a flow chart illustrating the various modes of use of the apparatus for a developmentally delayed person, or for a physically and/or neurologically impaired person, such as a child or adult. The left branch illustrates the use for a physical workout. The various roller resistance adjustments and height adjustments are used to optimally regulate the fraction of gravity force acting on the person, such as a child or adult, in the various desired positions. The central branch is more of a diagnostic and evaluative flow that would probably be administered by a trained therapist. The right hand branch is a sensory stimulation use of the equipment.

Example of Use and Operation

An experienced therapist observed two children using the apparatus of the present invention similar to that shown in FIGS. 1–2 and 6–10. One child had low tone and generalized weakness while the other child was with cerebral palsy and showed signs of spastic quadruparesis. The therapist was impressed by the versatility of the apparatus as she watched one child transition from quadruped to sitting to standing positions with "minimal and easy adjustments". She observed the "fluidity of movement" the child was able to demonstrate with the apparatus. The equipment allowed the child to experiment with a variety of movement strategies and options to interact with her environment. In addition to observing, the therapist also worked with the child with spastic quadruparesis using the apparatus of the present invention. The therapist concluded that she was able to modulate her own handling and positioning techniques since the apparatus provided "additional hands" to support the child thus creating greater positioning options. Unlike interaction with rigid surfaces, "the child was able to move, and then experience the consequences of his movement within a safe parameter".

The aforementioned embodiments are merely illustrative of several configurations for the present invention. For example the non-rotational support arm extension 109 can be used with either the various frames of FIGS. 12, 14, 15 or 16 or it can be used with any of the hand-held embodiments of FIGS. 17–19. Likewise these embodiments can be used with or without a spring, such as shown in FIG. 1. Similarly, a rotatable support arm extension be made optionally nonrotatable, such as with a pin shown in FIG. 13. The same is true for the hand-held embodiments of FIGS. 17–19.

Therefore, it is further noted that other modifications may be made to the present invention, without departing from the scope of the invention, as noted in the appended claims.

I claim:

1. An exercise and crawling assistive and walker device that supports a person, and permits movements over a two dimensional area with up and down adjustments to develop vestibular balance and muscle control so that the person can learn to perform mobility activities, such as crawling, sitting upright, standing or walking, comprising:

a support having a first plurality of fasteners;

a size adjustable body suit having a second plurality of fasteners, an expansion seam and a size adjustment member, said second plurality of fasteners being strategically placed to assist the person assume various postural positions ranging from upright sitting or standing positions, to oblique or horizontal crawling quadruped positions, to facilitate the vertically upright, oblique or horizontal positions, and said size adjustment member comprising at least one adjustable, teeth-geared, incremental fastener clasp, having a base with teeth gears, a tongue member and a lockable lever such that said tongue member intersects said base and is attached to said lockable lever to close said seam;

a plurality of flexible connector straps, each of said connector steps being connected between at least one of said first plurality of fasteners at a first end and at least one of said second plurality of fasteners at a second end, such that said flexible connector straps are positioned in spaced-apart relation to one another about said body suit when said body suit is suspended by said flexible connector straps thereby counteracting gravity to assist the person in attaining said sitting, standing, walking and crawling postural positions; and an adjustment member being provided to hold the person at a predetermined height from above, which height can be adjusted up or down to enable the person to move from a hand and knee weight bearing crawling position to a non-weight bearing, suspended position.

2. An exercise crawling assistive and walker device that supports a person, and permits movements over a two dimensional area with up and down adjustments to develop vestibular balance and muscle control so that the person can learn to perform mobility activities, such as crawling, sitting upright, standing or walking, comprising:

a self standing frame having a first plurality of fasteners and at least one support dolly having a sub-assembly for moving a body suit transversally to an axial movement of said support dolly;

said body suit being supported from above by said frame having a second plurality of fasteners, said second plurality of fasteners being strategically placed to assist the person assume various postural positions ranging from upright sitting or standing positions, to oblique or horizontal crawling quadruped positions, to facilitate the vertically upright, oblique or horizontal positions;

a plurality of flexible connector straps, each of said connector steps being connected between at least one of said first plurality of fasteners at a first end and at least one of said second plurality of fasteners at a second end such that said flexible connector straps are positioned in spaced-apart relation to one another about said body suit when said body suit is suspended by said flexible connector straps thereby counteracting gravity to assist the person in attaining said sitting, standing, walking and crawling postural positions; and an adjustment member being provided to hold the person at a predetermined height from above, which height can be adjusted up or down to enable the person to move from a hand and knee weight bearing crawling position to a non-weight bearing, suspended position.

3. The exercise crawling assistive and walker device as in claim 16 wherein said frame is a free standing frame.

4. The exercise crawling assistive and walker device as in claim 2 wherein said at least one support dolly includes a sub-assembly for rotating said body suit.

5. The exercise crawling assistive and walker device as in claim 2 wherein said body suit has spinal supports enhancing the posture of the person wearing said body suit.

* * * * *